US011858690B2

(12) United States Patent
Song et al.

(10) Patent No.: US 11,858,690 B2
(45) Date of Patent: Jan. 2, 2024

(54) TRAY

(71) Applicant: Samsung Display Co., LTD., Yongin-si (KR)

(72) Inventors: Young Dae Song, Seoul (KR); Kyeong Min Kim, Asan-si (KR); Eui Young Kim, Yongin-si (KR); Hong Ju Kim, Hwaseong-si (KR); Jung Gil Oh, Hwaseong-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/477,504

(22) Filed: Sep. 16, 2021

(65) Prior Publication Data

US 2022/0194660 A1 Jun. 23, 2022

(30) Foreign Application Priority Data

Dec. 17, 2020 (KR) ..... 10-2020-0176978

(51) Int. Cl.
*B65D 25/10* (2006.01)
*B65D 85/48* (2006.01)
*B65D 1/34* (2006.01)

(52) U.S. Cl.
CPC ..... *B65D 25/108* (2013.01); *B65D 1/34* (2013.01); *B65D 85/48* (2013.01)

(58) Field of Classification Search
CPC ..... B65D 85/48; B65D 1/34; B65D 25/107; B65D 25/101; B65D 25/103; B65D 25/10; B65D 25/108
USPC ..... 206/454
See application file for complete search history.

(56) References Cited

U.S. PATENT DOCUMENTS

2008/0099358 A1* 5/2008 Bell ..... B65D 25/107 206/319
2011/0056868 A1* 3/2011 Ting ..... B65D 85/48 206/587
2012/0211398 A1* 8/2012 Hu ..... B65D 5/5085 206/725
2013/0233759 A1* 9/2013 Chan ..... B65D 85/30 206/588
2020/0071024 A1* 3/2020 He ..... B65D 85/30
2021/0016957 A1* 1/2021 Song ..... B65D 25/005

FOREIGN PATENT DOCUMENTS

JP 200940431 A 2/2009
KR 1020210010722 A 1/2021

* cited by examiner

*Primary Examiner* — Steven A. Reynolds
(74) *Attorney, Agent, or Firm* — CANTOR COLBURN LLP

(57) ABSTRACT

A tray includes a main body portion including a bottom surface portion and a sidewall portion; and a plurality of first guide portions disposed on the bottom surface portion and arranged to be spaced apart from each other in a first direction. Each of the first guide portions includes a first main protruding portion, a first sub-protruding portion which protrudes from the first main protruding portion in the first direction, and a second sub-protruding portion which protrudes from the first main protruding portion in a direction opposite to the first direction, and the first sub-protruding portion and the second sub-protruding portion are alternately arranged in a direction the first main protruding portion extends.

20 Claims, 15 Drawing Sheets

PC1: PC11, PC12, PC13

TRAY

This application claims priority to Korean Patent Application No. 10-2020-0176978 filed on Dec. 17, 2020, and all the benefits accruing therefrom under 35 U.S.C. § 119, the content of which in its entirety is herein incorporated by reference.

BACKGROUND

1. Field of the Disclosure

The present disclosure relates to a tray.

2. Description of the Related Art

With development of multimedia, the importance of a display device has increased. Correspondingly, various kinds of display devices such as an organic light emitting diode ("OLED") display device and a liquid crystal display ("LCD") device have been used. The application fields of such a display device have diversified to various mobile electronic devices, e.g., portable electronic devices such as a smartphone, a smartwatch, and a tablet personal computer ("PC").

Meanwhile, in various display devices, a cover glass including a transparent area is disposed in front of a display panel to allow a user to view a display portion. The display panel is divided into a display area in which an actual image is displayed and a non-display area defined by an area excluding the display area. The cover glass may also be divided into a light transmitting area corresponding to the display area of the display panel and an opaque light shielding area corresponding to the non-display area. In the opaque light shielding area of the cover glass, a light shielding member may be disposed or predetermined ink may be printed to partially block light emitted from the display panel.

SUMMARY

Aspects of the present disclosure provide a tray facilitating transportation or storage of a cover glass of which at least one surface has a curved shape and which has a small thickness.

Aspects of the present disclosure also provide a tray capable of protecting a print layer formed on one surface of the cover glass from damage.

An embodiment of a tray includes a main body portion including a bottom surface portion and a sidewall portion; and a plurality of first guide portions disposed on the bottom surface portion and arranged to be spaced apart from each other in a first direction. Each of the first guide portions includes a first main protruding portion, a first sub-protruding portion which protrudes from the first main protruding portion in the first direction, and a second sub-protruding portion which protrudes from the first main protruding portion in a direction opposite to the first direction, and the first sub-protruding portion and the second sub-protruding portion are alternately arranged in a direction the first main protruding portion extends.

Another embodiment of a tray includes a main body portion including a bottom surface portion and a sidewall portion; a first guide portion disposed on the bottom surface portion; and a second guide portion disposed to be spaced apart from the first guide portion. The first guide portion includes a first sub-protruding portion which protrudes toward the second guide portion, the second guide portion includes a second sub-protruding portion which protrudes toward the first guide portion, and the first sub-protruding portion and the second sub-protruding portion are alternately arranged in a direction the first main protruding portion extends.

It should be noted that aspects of the present disclosure are not limited to the above-mentioned aspects, and other unmentioned aspects of the present disclosure will be apparent to those skilled in the art from the following descriptions.

BRIEF DESCRIPTION OF THE DRAWINGS

The above and other aspects and features of the present disclosure will become more apparent by describing exemplary embodiments thereof in detail with reference to the attached drawings, in which.

DETAILED DESCRIPTION

Figure 1:
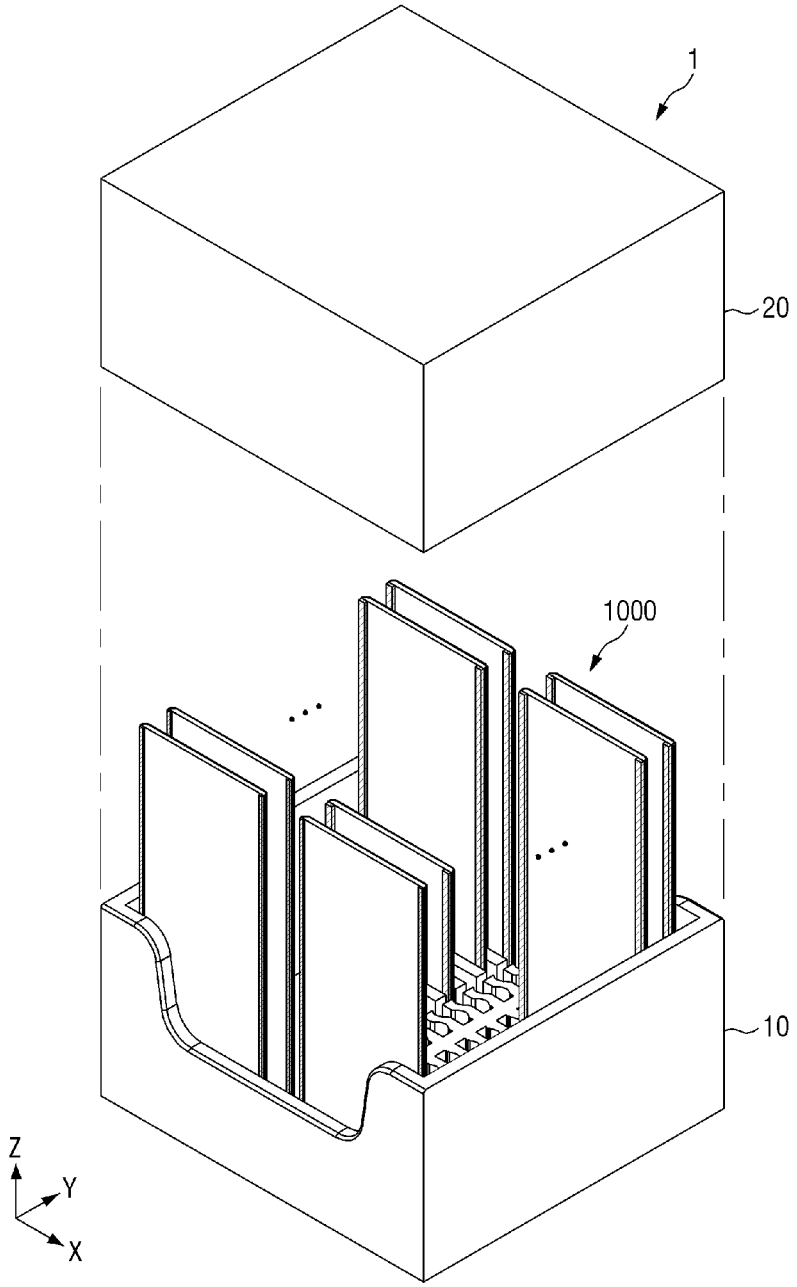
FIG. 1 is a perspective view of a cover glass loading container according to an embodiment.

The present invention will now be described more fully hereinafter with reference to the accompanying drawings, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art.

It will also be understood that when a layer is referred to as being "on" another layer or substrate, it can be directly on the other layer or substrate, or intervening layers may also be present. In contrast, when an element is referred to as being "directly on" another element, there are no intervening elements present.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

As used herein, "direction" means a course along which something is facing. For example, a first direction X may be a course from a left to a right, and a direction opposite to the first direction X may be a course from the right to the left.

The same reference numbers indicate the same components throughout the specification.

Hereinafter, specific embodiments will be described with reference to the accompanying drawings.

Figure 2:
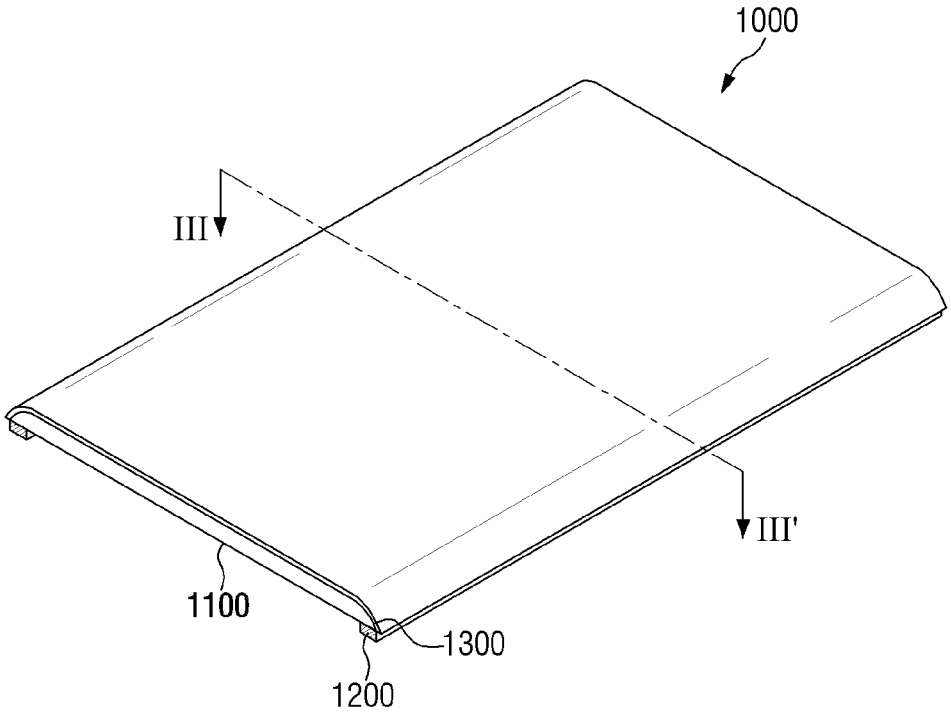
FIG. 2 is a perspective view of a cover glass according to an embodiment.
Figure 3:
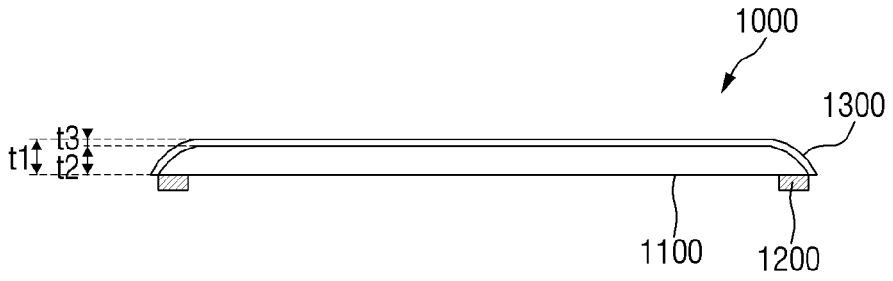
FIG. 3 is a cross-sectional view taken along line III-III' of FIG. 2.

FIG. 1 is a perspective view of a cover glass loading container according to an embodiment. FIG. 2 is a perspective view of a cover glass according to an embodiment. FIG. 3 is a cross-sectional view taken along line III-III' of FIG. 2.

Referring to FIGS. 1 to 3, a cover glass loading container 1 according to an embodiment may include a tray 10 and a tray cover 20 coupled to the tray 10. The tray 10 may provide a space in which one or more cover glasses 1000 may be loaded, and the tray cover 20 may be mounted on the tray 10 to protect the cover glasses 1000 loaded on the tray 10.

A plurality of cover glasses 1000 may be loaded on the tray 10. The plurality of cover glasses 1000 may be arranged to constitute one or more lines. FIG. 1 illustrates a case in which the plurality of cover glasses 1000 are arranged in a second direction Y and disposed to form two lines arranged in a first direction X, but the present disclosure is not limited thereto.

The cover glass 1000 according to an embodiment may include a glass member 1100, a print layer 1200 disposed on one surface of the glass member 1100, and a protective layer 1300 disposed on the other surface of the glass member 1100.

The glass member 1100 may have a rectangular shape in a plan view. The glass member 1100 may include a short side extending in one direction and a long side extending in another direction intersecting the one direction. The one surface of the glass member 1100 may include a flat surface. The other surface of the glass member 1100 may include edges disposed along long sides in the one direction and a direction opposite to the one direction, respectively, and curved in the one direction and the direction opposite to the one direction, respectively. However, the present disclosure is not limited thereto, and the other surface of the glass member 1100 may include edges disposed along short sides in the another direction and a direction opposite to the another direction, respectively, and curved in the one direction and the direction opposite to the one direction, respectively in another embodiment. The other surface of the glass member 1100 may also include both of the edges disposed along the long sides in the one direction and the direction opposite to the one direction, respectively, and curved and the edges disposed along the short sides in the another direction and a direction opposite to the another direction, respectively, and curved.

The glass member 1100 may constitute a portion of a display device (not illustrated) through some processes. The glass member 1100 may be disposed on a front surface of the display device (not illustrated) to cover other components such as a display panel (not illustrated) that constitute the display device (not illustrated).

The glass member 1100 may be made of a material that transmits light. The glass member 1100 may include silicon dioxide ($SiO_2$) as its main component and further include components such as aluminum oxide ($Al_2O_3$), lithium oxide ($LiO_2$), and sodium oxide ($Na_2O$), but the present disclosure is not limited thereto, and the glass member 1100 may further include other components in another embodiment. In one embodiment, the glass member 1100 may include glass ceramic that contains alkali alumino silicate.

The print layer 1200 may be disposed on one side edge and the other side edge of the one surface of the glass member 1100 in the one direction. That is, the print layer 1200 may be disposed on the opposite surface of the surface of the glass member 1100 including the curved edges. On at least one surface of the glass member 1100, the print layer 1200 may partially block light emitted from the display panel (not illustrated) to which the glass member 1100 is attached. The print layer 1200 may be made of a light shielding member or a predetermined ink.

On the one surface of the glass member 1100, the print layer 1200 may partially overlap with an area of the curved edge. The print layer 1200 may be disposed to extend in the one direction. When the cover glass 1000 is loaded on the tray 10, there is a need to prevent damage to the print layer 1200 formed on the cover glass 1000.

The protective layer 1300 may be disposed on the one surface of the glass member 1100. The protective layer 1300 may be disposed to protect the one surface of the glass member 1100. The protective layer 1300 may be disposed to protect the one surface of the glass member 1100 from an external environment during a manufacturing process of the display device (not illustrated) in which the cover glass 1000 is attached. The protective layer 1300 may be disposed on the entire area of the one surface of the glass member 1100 and also cover the curved edges of the glass member 1100.

The protective layer 1300 may be a protective film. For example, the protective layer 1300 may be made of at least any one material of polyethylene terephthalate ("PET"), thermoplastic polyurethane ("TPU"), polyvinyl chloride ("PVC"), polypropylene ("PP"), and polyimide ("PI") or a mixture thereof, but the present disclosure is not limited thereto.

The cover glass 1000 may further include an adhesive member (not illustrated) disposed between the protective layer 1300 and the glass member 1100. However, the present disclosure is not limited thereto, and one surface of the protective layer 1300 itself that comes in contact with the glass member 1100 may have adhesiveness in another embodiment.

A thickness t1 of the cover glass 1000 may be equal to the sum of a thickness t2 of the glass member 1100 and a thickness t3 of the protective layer 1300. The thickness t2 of the glass member 1100 may occupy most of the thickness t1 of the cover glass 1000. For example, the thickness t2 of the glass member 1100 may occupy about 70 percentages (%) or more, about 80% or more, or about 90% or more of the thickness t1 of the cover glass 1000. The thickness t1 of the cover glass 1000 may be less than or equal to about 0.8 millimeters (mm), less than or equal to about 1.0 mm, or less than or equal to about 2.0 mm but is not limited thereto.

The cover glass 1000 may be loaded on the tray 10 to be transported or stored. The tray 10 may have a structure that may prevent breakage of the cover glass 1000 and damage to the print layer 1200 during transportation or storage of the cover glass 1000 loaded on the tray 10. Hereinafter, the structure of the tray 10 that allows the cover glass 1000 to be stably loaded thereon and prevents damage to the print layer 1200 will be described.

Figure 4:
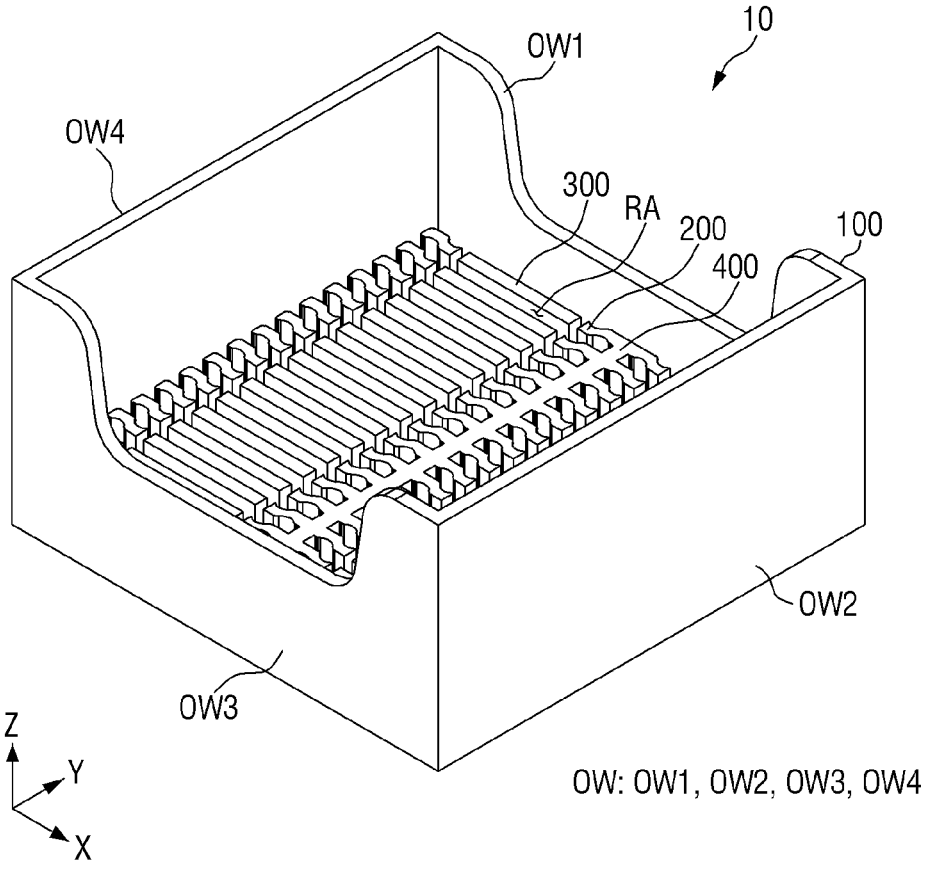
FIG. 4 is a perspective view of a tray according to an embodiment.
Figure 5:
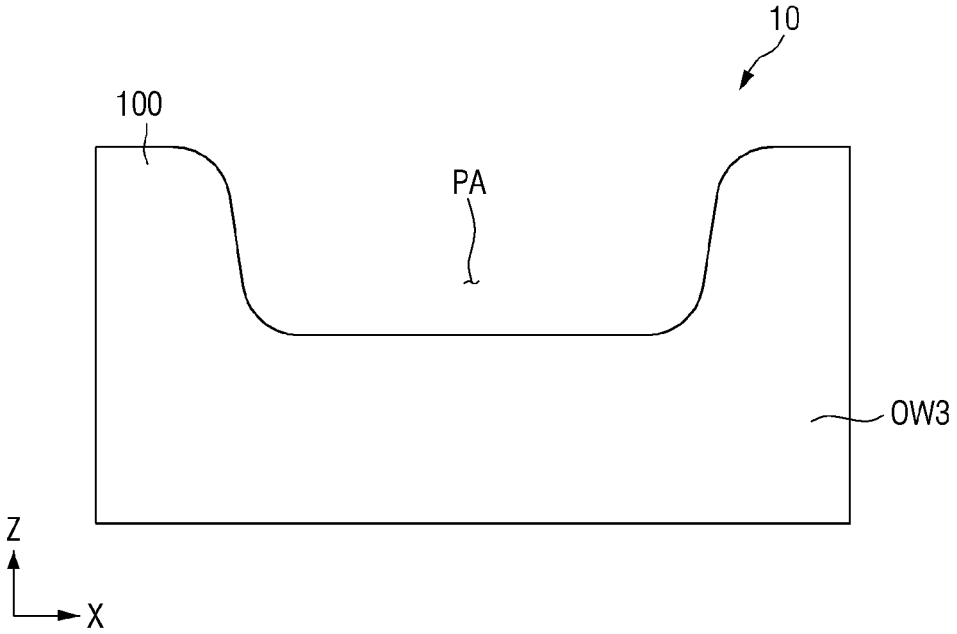
FIG. 5 is a lateral view of the tray according to an embodiment.
Figure 6:
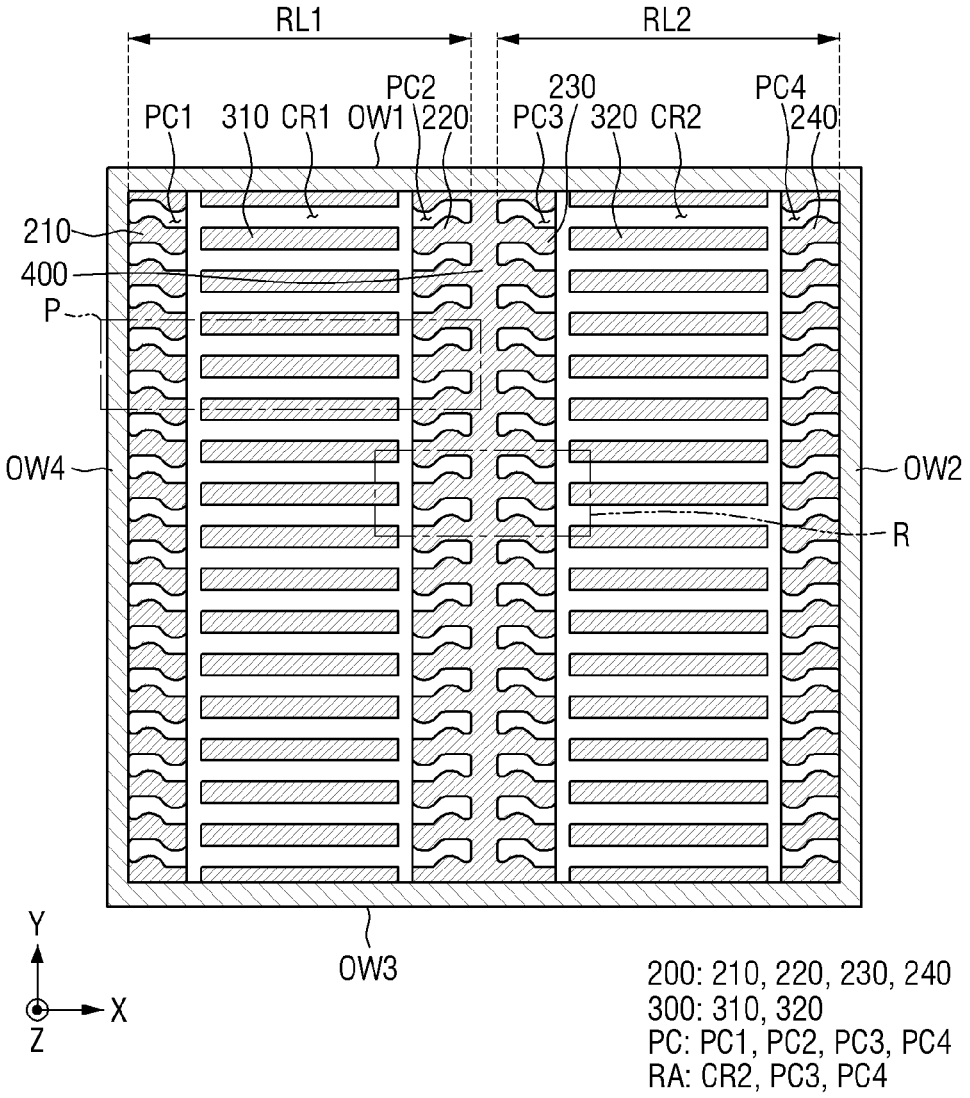
FIG. 6 is a plan view of the tray according to an embodiment.

FIG. 4 is a perspective view of a tray according to an embodiment. FIG. 5 is a lateral view of the tray according to an embodiment. FIG. 6 is a plan view of the tray according to an embodiment.

Referring to FIGS. 4 to 6, the tray 10 according to an embodiment may include a main body portion 100 and guide portions 200, partition portions 300, and a separation wall 400 that are disposed on the main body portion 100.

The main body portion 100 may include a plurality of sidewalls OW. The main body portion 100 may have a structure in which the guide portions 200 and the partition portions 300, which will be described below, are disposed on a bottom surface of the main body portion 100 and the sidewalls OW surround the guide portions 200 and the partition portions 300. The guide portion 200 may have a shape that protrudes from the sidewall OW of the main body portion 100 toward an inner side of the main body portion 100. The guide portion 200 may be integrally formed with (i.e., monolithic) the bottom surface and the sidewalls OW of the main body portion 100.

The sidewalls OW of the main body portion 100 have a predetermined height (in the third direction Z) and thickness. The sidewalls OW are disposed at outer boundaries of the bottom surface of the main body portion 100, and the height and thickness of the sidewalls OW may vary according to the number of cover glasses 1000 loaded on the tray 10. The sidewalls OW may include a first sidewall OW1 and a third sidewall OW3 that extend in the first direction X and a second sidewall OW2 and a fourth sidewall OW4 that extend in the second direction Y. The sidewalls OW extending in the same direction may be disposed to be opposite to each other. In an area therebetween, receiving portions RA into which the cover glasses 1000 are inserted to be loaded may be defined. The receiving portion RA may be defined by the bottom surface of the main body portion 100, a side surface of the guide portion 200, and a side surface of the partition portion 300.

The sidewalls OW of the main body portion 100 may be disposed to partially surround edges of the cover glass 1000. The sidewalls OW of the main body portion 100 may have a height which is lower than the loaded cover glass 1000 but which prevents the cover glass 1000 from falling out from between the guide portions 200 when the cover glass 1000 is loaded on the receiving portion RA to be transported or stored.

Although the drawings illustrate a case in which corners where the sidewalls OW meet are angular, the present disclosure is not limited thereto, and the corners may also have a round shape in another embodiment.

In some embodiments, at least some of the sidewalls OW of the main body portion 100 may have a flat upper surface that extends in one direction, and the rest of the sidewalls OW may have a curved upper surface that is partially recessed.

As illustrated in FIGS. 4 and 5, the second sidewall OW2 and the fourth sidewall OW4 may have a flat upper surface that extends in one direction, that is, the second direction Y, and the first sidewall OW1 and the third sidewall OW3 may have a curved upper surface that is partially recessed. In other words, the first sidewall OW1 and the third sidewall OW3 may partially have a different height, and an area surrounded by the sidewalls OW may be partially exposed through the first sidewall OW1 and the third sidewall OW3. When the tray 10 is viewed from the front (See FIG. 5), the upper surface of the third sidewall OW3 may include a recessed portion PA that is partially recessed to downward from a central portion, and the central portion of the third sidewall OW3 may have a height that is lower than a height at opposite side portions of the third sidewall OW3 in the third direction Z.

The first sidewall OW1 and the third sidewall OW3 of the main body portion 100 may define the recessed portion PA that is partially recessed. When the cover glass 1000 is being separated from the tray 10, an external mechanism may be fastened to the cover glass 1000 through the recessed portions PA of the first sidewall OW1 and the third sidewall OW3. As will be described below, the receiving portions RA, which are spaces on which the cover glasses 1000 are loaded, may be arranged in the second direction Y which is a direction in which the first sidewall OW1 and the third sidewall OW3 are opposite to each other. The cover glasses 1000 loaded on the receiving portions RA may also be arranged in the second direction Y in the tray 10 so as to be loaded. Since the recessed portion PA is formed in the first sidewall OW1 and the third sidewall OW3, the external mechanism may easily approach the cover glass 1000 in the second direction Y, and the cover glasses 1000 loaded in the second direction Y may be sequentially separated from the tray 10. However, the present disclosure is not limited thereto, and the shape of the sidewalls OW of the main body portion 100 may be changed within a predetermined range in another embodiment.

The tray 10 according to an embodiment may define the plurality of receiving portions RA therein. The plurality of receiving portions RA may be arranged to constitute one or more receiving lines RL that are arranged in one direction. A direction (i.e., the second direction Y) in which the plurality of receiving portions RA are arranged to constitute a single receiving line RL may be perpendicular to a direction (i.e., the first direction X) in which each receiving portion RA extends.

When a plurality of receiving lines RL are present, the plurality of receiving lines RL may be arranged in a direction (i.e., the first direction X) perpendicular to the direction in which each receiving line RL extends. For example, the receiving lines RL included in the tray 10 may include a first receiving line RL1 that extends in the second direction Y and a second receiving line RL2 that is disposed at one side of the first receiving line RL1 in the first direction X. Although FIG. 6 illustrates two receiving lines RL that extend in the second direction Y and are adjacent to each other in the first direction X, the direction in which the receiving lines RL extend and the number of the receiving lines RL according to the invention are not limited thereto.

The first receiving line RL1 may be disposed between the fourth sidewall OW4 and the separation wall 400 and may include first receiving portions RA1. The second receiving line RL2 may be disposed between the second sidewall OW2 and the separation wall 400 and may include second receiving portions RA2.

The guide portions 200 are disposed inside the main body portion 100. Specifically, the guide portions 200 may be disposed on the bottom surface of the main body portion 100. The plurality of guide portions 200 may be disposed to be spaced apart from each other. For example, the guide portions 200 may be disposed to be spaced apart at equal intervals in the second direction Y. The guide portions 200 adjacent to each other may define an edge receiving portion PC disposed therebetween. The edge receiving portion PC will be described in detail below.

The guide portions 200 may include a first guide portion 210 and a second guide portion 220 that are disposed in the first receiving line RL1 and disposed to be opposite to each other. The guide portions 200 may also include a third guide portion 230 and a fourth guide portion 240 that are disposed in the second receiving line RL2 and disposed to be opposite to each other.

The first guide portion 210 and the second guide portion 220 may protrude in opposite directions. For example, the first guide portion 210 and the second guide portion 220 may be disposed to be opposite to each other in the first direction X. The first guide portion 210 may have a shape that protrudes from the fourth sidewall OW4 in the first direction X (i.e., the direction to the right in FIG. 6), and the second guide portion 220 may have a shape that protrudes from the separation wall 400, which will be described below, in a direction opposite to the first direction X (i.e., the direction to the left in FIG. 6). The first guide portion 210 and the second guide portion 220 may be arranged in the first direction X. The first guide portion 210 and the second guide portion 220 that are disposed to be opposite to each other may have symmetrical structures with respect to a virtual line that is equidistant from the first guide portion 210 and the second guide portion 220 and extends in the second direction Y.

The first guide portion 210 may be disposed on the bottom surface of the main body portion 100. Also, the first guide portion 210 may have a shape that protrudes inward from an inner sidewall of the fourth sidewall OW4 and may have a structure integrally formed therewith. However, the present disclosure is not limited thereto, and the first guide portion 210 may also be formed as a separate member on the bottom surface of the main body portion 100 in another embodiment.

The tray 10 may include a plurality of first guide portions 210 that protrude from the sidewall OW (i.e., the fourth sidewall OW4). The plurality of first guide portions 210 may be arranged to be spaced apart from each other in a direction in which the sidewall OW (i.e., the fourth sidewall OW4), on which the first guide portions 210 are disposed, extends. For example, as illustrated in FIG. 6, the first guide portions 210 may be disposed on the inner sidewall of the fourth sidewall OW4 and arranged in the second direction Y.

The second guide portion 220 may be disposed on the bottom surface of the main body portion 100 and disposed on the separation wall 400 that is disposed to extend in the second direction Y on the bottom surface of the main body portion 100. As described above, the second guide portion 220 may have substantially the same shape as the first guide portion 210 and have a structure symmetrical thereto. That is, the second guide portion 220 may have a shape that protrudes from the separation wall 400 in the direction opposite to the first direction X and may have a structure integrally formed with the separation wall 400. However, the present disclosure is not limited thereto, and the second guide portion 220 may also be formed as a separate member on the bottom surface of the main body portion 100 in another embodiment.

A plurality of second guide portions 220 may be spaced apart from each other in a direction in which the separation wall 400 extends. For example, as illustrated in FIG. 6, the second guide portions 220 may have a shape that protrudes from the other side surface of the separation wall 400 in the first direction X and may be arranged in the second direction Y. Accordingly, the plurality of first receiving portions RA1 may also be arranged in the direction in which the first guide portions 210 and the second guide portions 220 are arranged.

The third guide portion 230 and the fourth guide portion 240 may protrude in opposite directions. For example, the third guide portion 230 and the fourth guide portion 240 may be disposed to be opposite to each other in the first direction X.

The third guide portion 230 may have a shape that protrudes from the separation wall 400, which will be described below, in the first direction X (i.e., the direction to the right in FIG. 6). The fourth guide portion 240 may have a shape that protrudes from the second sidewall OW2 in the direction opposite to the first direction X, and the third guide portion 230 and the fourth guide portion 240 may be arranged in the second direction Y. The third guide portion 230 and the fourth guide portion 240 that are disposed to be opposite to each other may have symmetrical structures with respect to a virtual line that is equidistant from the third guide portion 230 and the fourth guide portion 240 and extends in the second direction Y.

Since other details relating to the third guide portion 230 and the fourth guide portion 240 are substantially the same as the description of the first guide portion 210 and the second guide portion 220, additional description will be omitted.

The direction in which the first to fourth guide portions 210, 220, 230, and 240 are arranged is not limited to that illustrated in FIG. 6. In some cases, the first guide portion 210 and the fourth guide portion 240 may be disposed on an inner sidewall of the first sidewall OW1 or third sidewall OW3, and the separation wall 400 on which the second guide portion 220 is disposed may extend in the first direction X on the bottom surface of the main body portion 100. However, as described above, the direction in which the first to fourth guide portions 210, 220, 230, and 240 are arranged may be the same as the direction in which the receiving portions RA are arranged and the direction in which the plurality of cover glasses 1000 are sequentially loaded.

In order to allow the cover glasses 1000 to be smoothly separated, the direction in which the first to fourth guide portions 210, 220, 230, and 240 are arranged may correspond to a direction in which the sidewalls OW having the recessed portion PA defined therein are opposite to each other. That is, since the recessed portion PA is defined in the first sidewall OW1 and the third sidewall OW3 as in the drawings, the first to fourth guide portions 210, 220, 230, and 240 may be arranged in the second direction Y, which is the direction in which the first sidewall OW1 and the third sidewall OW3 are opposite to each other. On the other hand, when the recessed portion PA is defined in the second sidewall OW2 and the fourth sidewall OW4, the first guide portion 210 and the second guide portion 220 may be arranged in the first direction X, which is the direction in which the second sidewall OW2 and the fourth sidewall OW4 are opposite to each other.

The partition portions 300 may include a first partition portion 310 disposed between the first guide portion 210 and the second guide portion 220 and a second partition portion 320 disposed between the third guide portion 230 and the fourth guide portion 240. The plurality of partition portions 300 may be disposed on the bottom surface of the main body portion 100 and may be arranged to be spaced apart from each other in the second direction Y. A first center receiving portion CR1 may be defined between a plurality of first partition portions 310 that are adjacent to each other, and a second center receiving portion CR2 may be defined between a plurality of second partition portions 320 that are adjacent to each other.

A single first partition portion 310 may be disposed to correspond to a single first guide portion 210 and a single second guide portion 220. The first guide portion 210, the second guide portion 220, and the first partition portion 310 may constitute a single group and may be arranged in the second direction Y on the bottom surface of the main body portion 100. Between the groups, each of which consists of a single first guide portion 210, a single second guide portion 220, and a single first partition portion 310, that are adjacent to each other, the first receiving portion RA1 on which the cover glass 1000 is loaded may be defined.

Likewise, a single second partition portion 320 may be disposed to correspond to a single third guide portion 230 and a single fourth guide portion 240. The third guide portion 230, the fourth guide portion 240, and the second partition portion 320 may constitute a single group and may be arranged in the second direction Y on the bottom surface of the main body portion 100. Between the groups, each of which consists of a single third guide portion 230, a single fourth guide portion 240, and a single second partition portion 320, that are adjacent to each other, the second receiving portion RA2 on which the cover glass 1000 is loaded may be defined.

Meanwhile, according to an embodiment, at least one surface of the cover glass 1000 may have a predetermined curvature and have a curved shape. When the cover glass 1000 is loaded on the tray 10, an edge of the cover glass 1000 may be loaded between the guide portions 200 adjacent to each other, and a flat surface of the cover glass 1000 may be loaded between the partition portions 300 adjacent to each other.

The guide portion 200 may have a structure that prevents the print layer 1200, which is disposed on one surface of the cover glass 1000, from coming in contact with another member. Hereinafter, the shape and structure of the guide portion 200 will be described in more detail with reference to other drawings.

Figure 7:
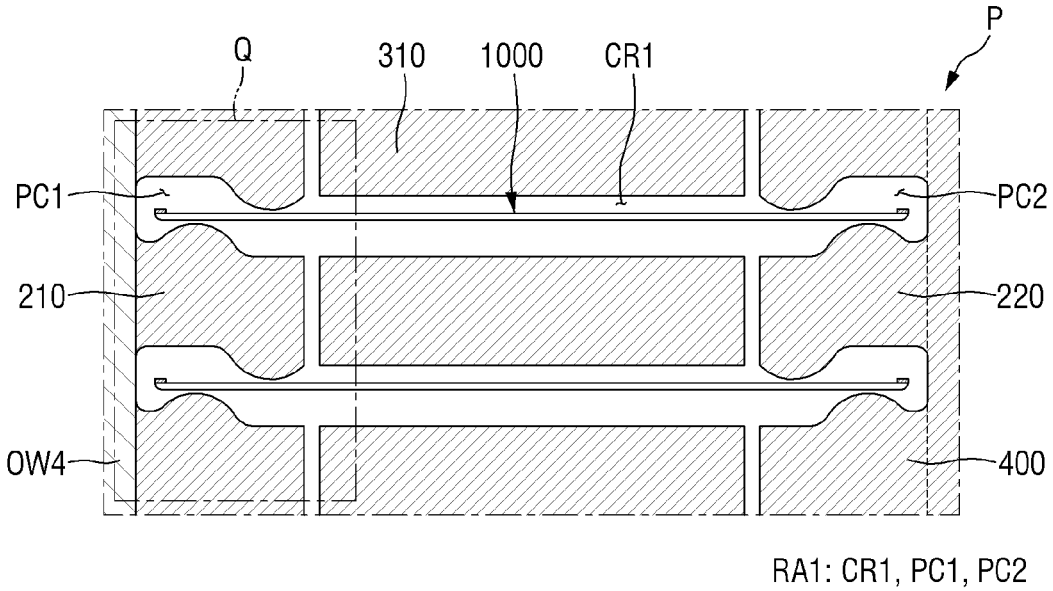
FIG. 7 is an enlarged view of area P of FIG. 6.
Figure 8:
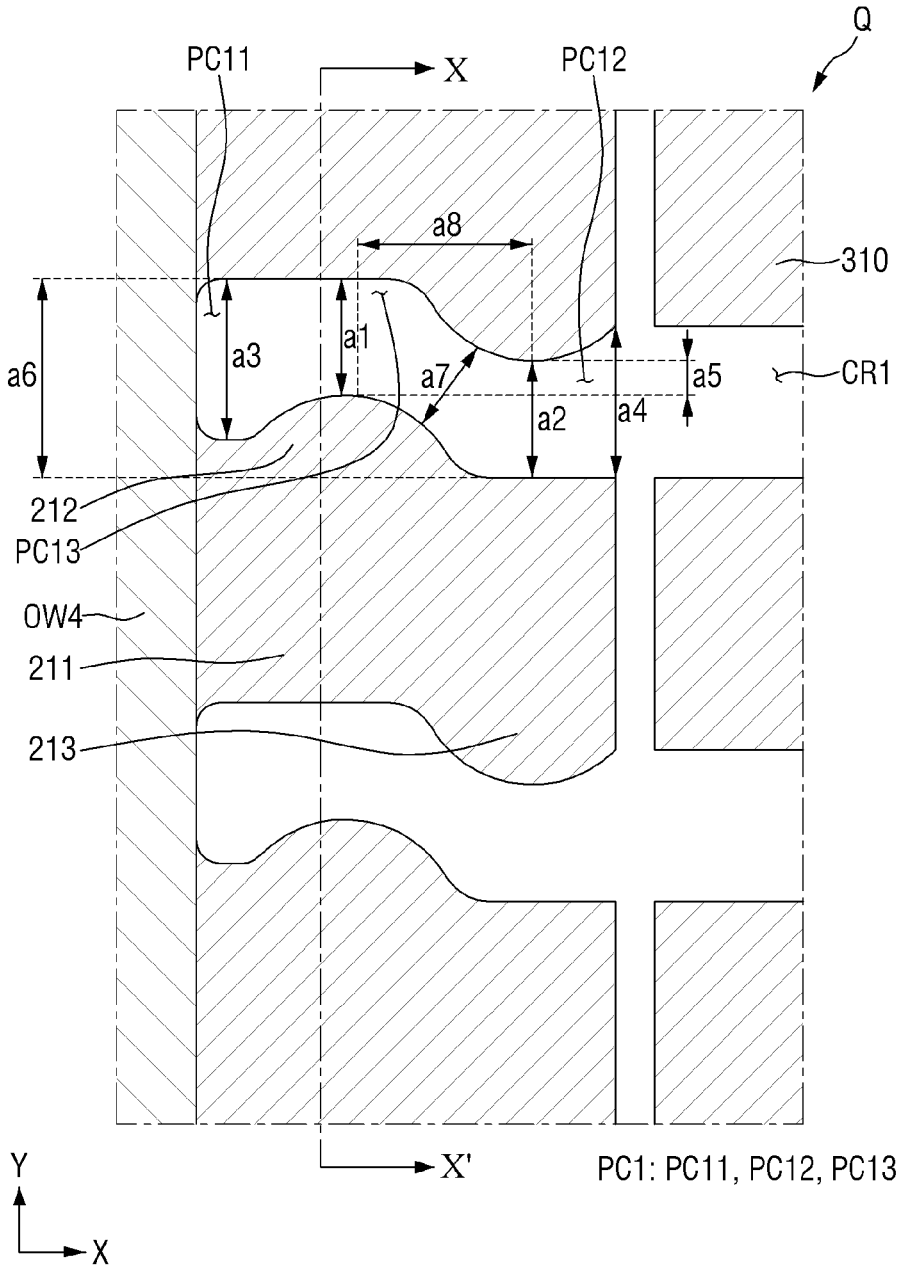
FIG. 8 is an enlarged view of area Q of FIG. 7.
Figure 9:
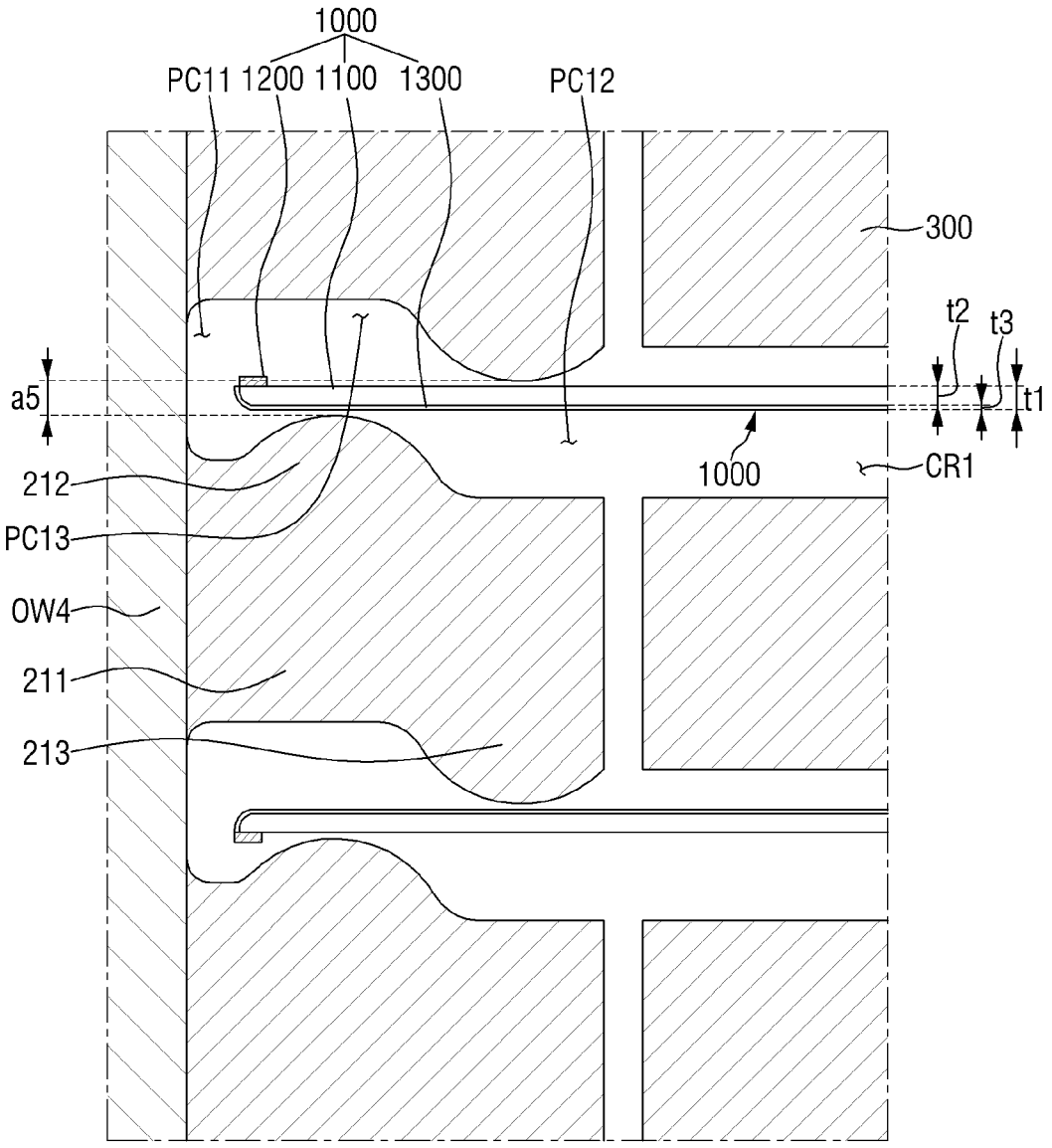
FIG. 9 is an enlarged view of a portion of the tray on which the cover glass is loaded.
Figure 10:
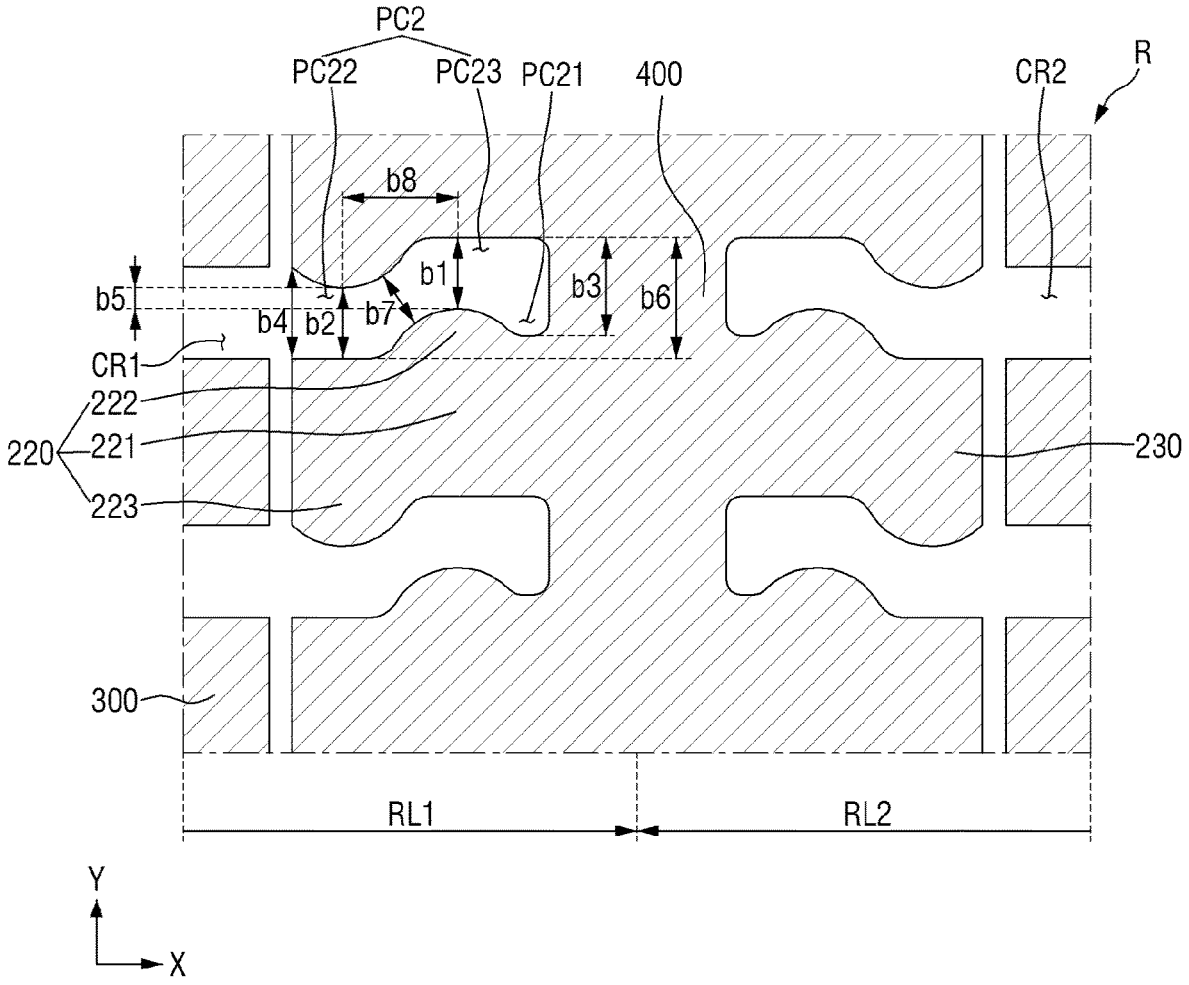
FIG. 10 is an enlarged view of area R of FIG. 6.

FIG. 7 is an enlarged view of area P of FIG. 6. FIG. 8 is an enlarged view of area Q of FIG. 7. FIG. 9 is an enlarged view of a portion of the tray on which the cover glass is loaded. FIG. 10 is an enlarged view of area R of FIG. 6.

Referring to FIGS. 7 to 10, the guide portion 200 included in the tray 10 according to an embodiment may have a structure that allows the cover glass 1000 having a small thickness to be stably loaded on the receiving portion RA and prevents damage to the print layer 1200.

The following description will be given on the basis of the first receiving portion RA1, the first guide portion 210, the second guide portion 220, and the first partition portion 310 that are disposed in the first receiving line RL1, but the description may also apply to the second receiving line RL2.

Specifically, the first guide portion 210 may include a first main protruding portion 211 and a first sub-protruding portion 212 and a second sub-protruding portion 213 that protrude from the first main protruding portion 211 in the second direction Y and in the direction opposite to the second direction Y, respectively. The second guide portion 220 may include a second main protruding portion 221 and a third sub-protruding portion 222 and a fourth sub-protruding portion 223 that protrude from the second main protruding portion 221 in the second direction Y and in the direction opposite to the second direction Y, respectively.

As described above, the first partition portion 310 may be disposed between the first guide portion 210 and the second guide portion 220. Although the drawings illustrate a case in which the first partition portion 310 is disposed to be spaced apart from the first guide portion 210 and the second guide portion 220, the present disclosure is not limited thereto, and the first partition portion 310 may also be connected to the first guide portion 210 and the second guide portion 220 in another embodiment.

The first guide portion 210 and the second guide portion 220 may have symmetrical structures with respect to a virtual line that extends in the second direction Y and divides the first partition portion 310, which is disposed between the first guide portion 210 and the second guide portion 220, into two equal portions.

The first main protruding portion 211 may have a shape that protrudes from the fourth sidewall OW4 in the first direction X (i.e., the direction to the right in FIG. 8). The first sub-protruding portion 212 may have a shape that protrudes from the first main protruding portion 211 in the second direction Y. The second sub-protruding portion 213 may have a shape that protrudes from the first main protruding portion 211 in the direction opposite to the second direction Y. In a single first guide portion 210, the directions in which the first sub-protruding portion 212 and the second sub-protruding portion 213 protrude may be reversed.

The first sub-protruding portion 212 and the second sub-protruding portion 213 may be disposed to alternately protrude. The first sub-protruding portion 212 and the second sub-protruding portion 213 being disposed to alternately protrude may mean that a protruding end portion of the first sub-protruding portion 212 and a protruding end portion of the second sub-protruding portion 213 are alternately disposed instead of being aligned in a straight line in the second direction Y. The protruding end portion of the first sub-protruding portion 212 may refer to a point of the first sub-protruding portion 212 that is located closest to one side in the second direction Y, and the protruding end portion of the second sub-protruding portion 213 may refer to a point of the second sub-protruding portion 213 that is located farthest in the direction opposite to the second direction Y.

Also, the first sub-protruding portion 212 and the second sub-protruding portion 213 may partially overlap in the second direction Y. The first sub-protruding portion 212 and the second sub-protruding portion 213 partially overlapping in the second direction Y may mean that a portion of the first sub-protruding portion 212 and a portion of the second sub-protruding portion 213 are disposed to be opposite to each other in the second direction Y.

In the first guide portion 210, the first sub-protruding portion 212 may be disposed between the first main protruding portion 211 and the fourth sidewall OW4. The first sub-protruding portion 212 may be partially connected to the first main protruding portion 211 and the fourth sidewall OW4. The first sub-protruding portion 212 may have a structure in which a thickness increases in a direction from the fourth sidewall OW4 toward the protruding end portion of the first main protruding portion 211 and then decreases. Here, the thickness of the first sub-protruding portion 212 may refer to a thickness in the second direction Y. Also, the protruding end portion of the first main protruding portion 211 may refer to one side end portion of the first main protruding portion 211 in the first direction X.

Specifically, a thickness of the other side end portion of the first sub-protruding portion 212 in the first direction X may be larger than a thickness of one side end portion thereof in the first direction X. However, the thickness of the other side end portion of the first sub-protruding portion 212 in the first direction X may be smaller than a thickness of the first sub-protruding portion 212 at the protruding end portion thereof. At one side of the first sub-protruding portion 212 in the first direction X, one side surface of the first main protruding portion 211 in the second direction Y may be exposed to a first edge receiving portion PC1.

The other side end portion of the first sub-protruding portion 212 in the first direction X may be connected to the fourth sidewall OW4, and one side end portion thereof in the first direction X may be connected to the first main protruding portion 211. One side surface of the first sub-protruding portion 212 in the second direction Y that is exposed may be disposed between the fourth sidewall OW4 and the one side surface of the first main protruding portion 211 in the second direction Y.

The second sub-protruding portion 213 may be disposed to protrude from the protruding end portion of the first main protruding portion 211 in a direction opposite to the second direction Y. The second sub-protruding portion 213 may have a structure in which a thickness increases in a direction from the protruding end portion of the first main protruding portion 211 toward the fourth sidewall OW4 and then decreases. Here, the thickness of the second sub-protruding portion 213 may refer to a thickness in the second direction Y.

Specifically, a thickness of one side end portion of the second sub-protruding portion 213 in the first direction X may be larger than a thickness of the other side end portion thereof in the first direction X. However, the thickness of the one side end portion of the second sub-protruding portion 213 in the first direction X may be smaller than a thickness of the second sub-protruding portion 213 at the protruding end portion thereof. At the other side of the second sub-protruding portion 213 in the first direction X, the other side surface of the first main protruding portion 211 in the second direction Y may be exposed to the first edge receiving portion PC1.

The other side end portion and one side end portion of the second sub-protruding portion 213 in the first direction X may be connected to the first main protruding portion 211. One side surface of the second sub-protruding portion 213 in the first direction X that is exposed and the other side surface thereof in the second direction Y may be disposed between one side surface of the first main protruding portion 211 in the first direction X and the other side surface of the first main protruding portion 211 in the second direction Y.

The first sub-protruding portion 212 of one first guide portion 210 may be disposed further in the direction opposite to the second direction Y than the second sub-protruding portion 213 of another first guide portion 210 that is disposed adjacent to the one first guide portion 210 in the second direction Y.

In the second guide portion 220, the second main protruding portion 221 may have a shape that protrudes from the separation wall 400 in the direction opposite to the first direction X. The third sub-protruding portion 222 may have a shape that protrudes from the second main protruding portion 221 in the second direction Y. The fourth sub-protruding portion 223 may have a shape that protrudes from the second main protruding portion 221 in the direction opposite to the second direction Y. In a single second guide portion 220, the directions in which the third sub-protruding portion 222 and the fourth sub-protruding portion 223 protrude may be reversed.

The third sub-protruding portion 222 and the fourth sub-protruding portion 223 may be alternately disposed. Hereinafter, a positional relationship between the third sub-protruding portion 222 and the fourth sub-protruding portion 223 may refer to a positional relationship between a protruding end portion of the third sub-protruding portion 222 and a protruding end portion of the fourth sub-protruding portion 223. That is, the third sub-protruding portion 222 and the fourth sub-protruding portion 223 being alternately disposed may mean that the protruding end portion of the third sub-protruding portion 222 and the protruding end portion of the fourth sub-protruding portion 223 are alternately disposed. Also, the protruding end portion of the third sub-protruding portion 222 may refer to a point of the third sub-protruding portion 222 that is located closest to one side in the second direction Y, and the protruding end portion of the fourth sub-protruding portion 223 may refer to a point of the fourth sub-protruding portion 223 that is located farthest in the direction opposite to the second direction Y.

The third sub-protruding portion 222 may be disposed between the second main protruding portion 221 and the second sidewall OW2. The third sub-protruding portion 222 may be partially connected to the second main protruding portion 221 and the second sidewall OW2. The third sub-protruding portion 222 may have a structure in which a thickness increases in a direction from the second sidewall OW2 toward the protruding end portion of the second main protruding portion 221 and then decreases. Here, the thickness of the third sub-protruding portion 222 may refer to a thickness in the second direction Y. Also, the protruding end portion of the second main protruding portion 221 may refer to the other side end portion of the second main protruding portion 221 in the first direction X.

Specifically, a thickness of one side end portion of the third sub-protruding portion 222 in the first direction X may be larger than a thickness of the other side end portion thereof in the first direction X. However, the thickness of the one side end portion of the third sub-protruding portion 222 in the first direction X may be smaller than a thickness of the third sub-protruding portion 222 at the protruding end portion thereof. At the other side of the third sub-protruding portion 222 in the first direction X, one side surface of the second main protruding portion 221 in the second direction Y may be exposed to a second edge receiving portion PC2.

The one side end portion of the third sub-protruding portion 222 in the first direction X may be connected to the second sidewall OW2, and the other side end portion thereof in the first direction X may be connected to the second main protruding portion 221. One side surface of the third sub-protruding portion 222 in the second direction Y that is exposed may be disposed between the second sidewall OW2 and the one side surface of the second main protruding portion 221 in the second direction Y.

The fourth sub-protruding portion 223 may be disposed to protrude from the protruding end portion of the second main protruding portion 221 in the direction opposite to the second direction Y. The fourth sub-protruding portion 223 may have a structure in which a thickness increases in a direction from the protruding end portion of the second main protruding portion 221 toward the second sidewall OW2 and then decreases. Here, the thickness of the fourth sub-protruding portion 223 may refer to a thickness in the second direction Y.

Specifically, a thickness of the other side end portion of the fourth sub-protruding portion 223 in the first direction X may be larger than a thickness of one side end portion thereof in the first direction X. However, the thickness of the other side end portion of the fourth sub-protruding portion 223 in the first direction X may be smaller than a thickness of the fourth sub-protruding portion 223 at the protruding end portion thereof. At one side of the fourth sub-protruding portion 223 in the first direction X, the other side surface of the second main protruding portion 221 in the second direction Y may be exposed to the second edge receiving portion PC2.

One side end portion and the other side end portion of the fourth sub-protruding portion 223 in the first direction X may be connected to the second main protruding portion 221. The other side surface of the fourth sub-protruding portion 223 in the first direction X that is exposed and the other side surface thereof in the second direction Y may be disposed between the other side surface of the second main protruding portion 221 in the first direction X and the other side surface of the second main protruding portion 221 in the second direction Y.

The fourth sub-protruding portion 223 may be disposed further in the second direction Y than the third sub-protruding portion 222.

Hereinafter, the first receiving portion RA1 that is defined by the first guide portion 210, the second guide portion 220, the second sidewall OW2, the fourth sidewall OW4, the partition portion 310, and the separation wall 400 will be described in detail.

The tray 10 according to an embodiment may include the plurality of receiving portions RA. Each receiving portion RA may have a shape that extends in the first direction X. The plurality of receiving portions RA may be arranged in the second direction Y. The plurality of receiving portions RA may include the first receiving portion RA1 included in the first receiving line RL1 disposed between the fourth sidewall OW4 and the separation wall 400 and the second receiving portion RA2 included in the second receiving line RL2 disposed between the second sidewall OW2 and the separation wall 400. Hereinafter, the receiving portion RA will be described on the basis of the first receiving portion RA1 included in the first receiving line RL1, but the description may also apply to the second receiving portion RA2.

The first receiving portion RA1 may include the first center receiving portion CR1 extending in the first direction X and the edge receiving portion PC disposed at one side and the other side of the first center receiving portion CR1 in the first direction X. The first center receiving portion CR1 may be defined as an area between the first partition portions 310 adjacent to each other in the second direction Y. The first center receiving portion CR1 may have a shape that extends in the first direction X. When the cover glass 1000 is loaded on the first receiving portion RA1, an area between opposite side edges of the cover glass 1000 may be loaded on the first center receiving portion CR1. In a plan view, the first center receiving portion CR1 may have a rectangular shape that includes long sides in the first direction X and short sides in the second direction Y.

The edge receiving portion PC may be disposed on each of one side and the other side of the first center receiving portion CR1 in a direction in which the first center receiving portion CR1 extends. The edge receiving portions PC may include the first edge receiving portion PC1 disposed at the other side of the first center receiving portion CR1 in the first direction X and the second edge receiving portion PC2 disposed at one side of the first center receiving portion CR1 in the first direction X. The edge receiving portions PC may be spatially connected to the first center receiving portion CR1.

The first edge receiving portion PC1 is a space between the first guide portions 210 adjacent to each other and may be defined by the first guide portions 210 adjacent to each other and the fourth sidewall OW4 connected to the first guide portions 210.

The first edge receiving portion PC1 may include a first sub-edge receiving portion PC11 that is disposed at a position from the fourth sidewall OW4 in the first direction X (i.e., the direction to the right in FIG. 8) and corresponds to an area up to the protruding end portion of the first sub-protruding portion 212. The first edge receiving portion PC1 may also include a second sub-edge receiving portion PC12 that extends from the protruding end portion of the first main protruding portion 211 in the direction opposite to the first direction X and corresponds to an area up to the protruding end portion of the second sub-protruding portion 213. The first edge receiving portion PC1 may also include a third sub-edge receiving portion PC13 that is disposed between the first sub-edge receiving portion PC11 and the second sub-edge receiving portion PC12. In the first edge receiving portion PC1, the third sub-edge receiving portion PC13 may correspond to an area from the protruding end portion of the first sub-protruding portion 212 to the protruding end portion of the second sub-protruding portion 213 in the first direction X.

When the cover glass 1000 is loaded on the tray 10 according to an embodiment, at least a portion of the print layer 1200 of the cover glass 1000 may be disposed in the first sub-edge receiving portion PC11. The cover glass 1000 may be disposed so that the print layer 1200 faces the one side in the second direction Y in the first sub-edge receiving portion PC11, but the present disclosure is not limited thereto, and the cover glass 1000 may also be disposed so that the print layer 1200 faces the direction opposite to the second direction Y therein in another embodiment. However, the cover glass 1000 being disposed so that the print layer 1200 faces the one side in the second direction Y, where an area is larger, in the first sub-edge receiving portion PC11 may be more advantageous in terms of protecting the print layer 1200.

When the print layer 1200 is disposed to face the one side in the second direction Y, the protective layer 1300 may be disposed close to the first sub-protruding portion 212, and the one surface of the glass member 1100 may be disposed close to the second sub-protruding portion 213. Conversely, when the print layer 1200 is disposed to face the direction opposite to the second direction Y, the protective layer 1300 may be disposed close to the second sub-protruding portion 213, and the one surface of the glass member 1100 may be disposed close to the first sub-protruding portion 212.

In the first edge receiving portion PC1, a width may vary for each area. First to eighth widths a1 to a8 which will be described below may refer to lengths in the second direction Y.

The first edge receiving portion PC1 may have the first width a1 between the protruding end portion of the first sub-protruding portion 212 of one first guide portion 210 and the other side surface of the first main protruding portion 211 in the second direction Y of another first guide portion 210 that is disposed adjacent to the one side of the one first guide portion 210 in the second direction Y. The first width a1 may refer to the smallest width measured in the second direction Y in the first sub-edge receiving portion PC11. Also, the first width a1 may be a width in the second direction Y that is measured at the other side of the third sub-edge receiving portion PC13 in the first direction X.

The first edge receiving portion PC1 may have the second width a2 between the protruding end portion of the second sub-protruding portion 213 of one first guide portion 210 and the one side surface of the first main protruding portion 211 in the second direction Y of another first guide portion 210 that is disposed adjacent to the other side of the one first guide portion 210 in the second direction Y. The second width a2 may refer to the smallest width measured in the second direction Y in the second sub-edge receiving portion PC12. Also, the second width a2 may be a width in the second direction Y that is measured at the one side of the third sub-edge receiving portion PC13 in the first direction X. The second width a2 may have substantially the same value as the first width a1, but the present disclosure is not limited thereto.

The first edge receiving portion PC1 may have the third width a3 in the second direction Y between an end portion of the first sub-protruding portion 212 in the direction opposite to the first direction X of one first guide portion 210 and aside surface of the first main protruding portion 211 in the direction opposite to the second direction Y of another first guide portion 210 that is disposed adjacent to the one first guide portion 210 in the second direction Y. The third width a3 may refer to the largest width measured in the second direction Y in the first sub-edge receiving portion PC11. The third width a3 may have a larger value than each of the first width a1 and the second width a2, but the present disclosure is not limited thereto.

The first edge receiving portion PC1 may have the fourth width a4 between the one side end portion of the second sub-protruding portion 213 in the first direction X of one first guide portion 210 and the one side surface of the first main protruding portion 211 in the second direction Y of another first guide portion 210 that is disposed adjacent to the other side of the one first guide portion 210 in the second direction Y. The fourth width a4 may refer to the largest width measured in the second direction Y in the second sub-edge receiving portion PC12. The fourth width a4 may have substantially the same value as the third width a3, but the present disclosure is not limited thereto. Also, like the third width a3, the fourth width a4 may have a larger value than each of the first width a1 and the second width a2.

The first edge receiving portion PC1 may have the fifth width a5 between a virtual tangent plane of the protruding end portion of the first sub-protruding portion 212 of one first guide portion 210 and a virtual tangent plane of the protruding end portion of the second sub-protruding portion 213 of another first guide portion 210 that is disposed adjacent to the one side of the one first guide portion 210 in the second direction Y. In other words, the fifth width a5 may refer to a gap in the second direction Y between the first sub-protruding portion 212 and the second sub-protruding portion 213 that are opposite to each other. The thickness t1 of the cover glass 1000 loaded on the receiving portion RA may at least be less than or equal to the fifth width a5. The fifth width a5 may be less than each of the first to fourth widths a1 to a4. The fifth width a5 may also be less than each of the sixth to eighth widths a6 to a8 which will be described below. That is, the fifth width a5 may be less than any gap measured between the first guide portions 210 adjacent to each other.

The tray 10 according to an embodiment may be manufactured through vacuum forming using a mold. When processing the mold for manufacturing the tray 10, a minimum processing width may be present. For example, the minimum processing width may be about 2.5 mm. However, through the structure including the first sub-protruding portion 212 and the second sub-protruding portion 213 that are opposite to each other and alternately disposed, the tray 10 according to an embodiment may secure the fifth width a5 that has a smaller value than the minimum processing width.

In a case in which a gap between the cover glass 1000 and the tray 10 is large, when the cover glass 1000 is loaded on the tray 10 to be stored or transported, the cover glass 1000 may be damaged due to external impact. Therefore, even when the cover glass 1000 loaded on the tray 10 according to an embodiment has the thickness t1 smaller than the minimum processing width, since damage to the cover glass 1000 due to the gap does not occur, the cover glass 1000 may be stably loaded.

The first edge receiving portion PC1 may have the sixth width a6 between a virtual plane that extends from the other side surface of the first main protruding portion 211 in the second direction Y of one first guide portion 210 and a virtual plane that extends from the one side surface of the first main protruding portion 211 in the second direction Y of another first guide portion 210 that is disposed adjacent to the other side of the one first guide portion 210 in the second direction Y. In other words, the sixth width a6 may refer to a separation distance between the first main protruding portions 211 of the first guide portions 210 adjacent to each other.

The first edge receiving portion PC1 may have the seventh width a7 as the shortest distance between the first sub-protruding portion 212 and the second sub-protruding portion 213. The width a7 may be less than or equal to each of the first width a1 and the second width a2, but the present disclosure is not limited thereto.

In the first edge receiving portion PC1, the protruding end portion of the first sub-protruding portion 212 and the protruding end portion of the second sub-protruding portion 213 may be spaced apart by as much as the eighth width a8 in the first direction X.

The second edge receiving portion PC2 is a space between the second guide portions 220 adjacent to each other and may be defined by the second guide portions 220 adjacent to each other and the separation wall 400 connected to the second guide portions 220. Similar to the above-described relationship between the first guide portion 210 and the second guide portion 220, the second edge receiving portion PC2 may have a structure symmetrical to the first edge receiving portion PC1 with respect to a virtual line that extends in the second direction Y and divides the first partition portion 310, which is disposed between the first guide portion 210 and the second guide portion 220, into two equal portions.

The second edge receiving portion PC2 may include a fourth sub-edge receiving portion PC21 that is defined at a position in the direction opposite to the first direction X (i.e., the direction to the left in FIG. 10) from the separation wall 400 and corresponds to an area up to the protruding end portion of the third sub-protruding portion 222. The second edge receiving portion PC2 may also include a fifth sub-edge receiving portion PC22 that is defined at a position in the first direction X from the protruding end portion of the second main protruding portion 221 and corresponds to an area up to the protruding end portion of the fourth sub-protruding portion 223. The second edge receiving portion PC2 may also include a sixth sub-edge receiving portion PC23 that is defined between the fourth sub-edge receiving portion PC21 and the fifth sub-edge receiving portion PC22. In the second edge receiving portion PC2, the sixth sub-edge receiving portion PC23 may correspond to an area from the protruding end portion of the third sub-protruding portion 222 to the protruding end portion of the fourth sub-protruding portion 223 in the first direction X.

The fourth sub-edge receiving portion PC21 may have a structure symmetrical to the first sub-edge receiving portion PC11, the fifth sub-edge receiving portion PC22 may have a structure symmetrical to the second sub-edge receiving portion PC12, and the sixth sub-edge receiving portion PC23 may have a structure symmetrical to the third sub-edge receiving portion PC13.

Therefore, since the description relating to the fourth to sixth sub-edge receiving portions PC21, PC22, and PC23 is substantially the same as the description relating to the first to third sub-edge receiving portions PC11, PC12, and PC13 except that the directions are reversed, additional description thereof will be omitted. Since the description relating to first to eighth widths bl to b8 of the second edge receiving portion PC2 is also substantially the same as the description relating to the first to eighth widths a1 to a8 of the first edge receiving portion PC1, additional description thereof will be omitted.

The second receiving portion RA2 may have a structure symmetrical to the first receiving portion RA1 with respect to a virtual line that extends in the second direction Y and divides the separation wall 400 into two equal portions. Also, the third guide portion 230 may have substantially the same structure as the first guide portion 210 and may have a structure symmetrical to the second guide portion 220 with respect to a virtual line that extends in the second direction Y and divides the separation wall 400 into two equal portions. The fourth guide portion 240 may have substantially the same structure as the second guide portion 220 and may have a structure symmetrical to the first guide portion 210 with respect to the virtual line that extends in the second direction Y and divides the separation wall 400 into two equal portions.

Since the tray 10 according to an embodiment includes the first guide portion 210 including the first sub-protruding portion 212 and the second sub-protruding portion 213 that are opposite to each other and alternately disposed and includes the second guide portion 220 including the third sub-protruding portion 222 and the fourth sub-protruding portion 223, even when the thickness of the cover glass 1000 loaded on the tray 10 is small, the cover glass 1000 may be stably loaded thereon. Specifically, the gap between the guide portion 200 and the cover glass 1000 may be reduced to minimize damage to the cover glass 1000 during storage and transportation of the cover glass 1000 loaded on the tray 10.

Also, the tray 10 according to an embodiment may secure the edge receiving portion PC to prevent damage to the print layer 1200 of the cover glass 1000 loaded on the tray 10.

Figure 11:
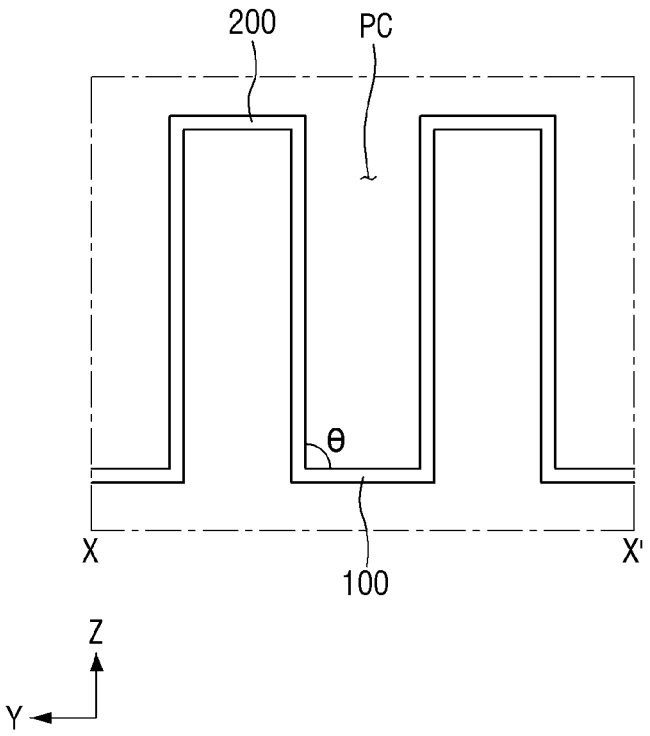
FIG. 11 is a cross-sectional view taken along line X-X' of FIG. 8.

FIG. 11 is a cross-sectional view taken along line X-X' of FIG. 8.

Referring to FIG. 11, the tray 10 according to an embodiment may not include an undercut structure that hinders removing the product from a mold. The tray 10 may be manufactured through forming using a mold. For example, the tray 10 may be manufactured through vacuum forming. When separating the tray 10 from the mold during the process of manufacturing the tray 10 through vacuum forming, the separating may not be easy when the tray 10 includes an undercut structure.

Specifically, an angle θ between the bottom surface of the main body portion 100 of the tray 10 and the sidewall of the guide portion 200 may be larger than or equal to about 90 degrees (°). An angle (not illustrated) between the bottom surface of the main body portion 100 and the inner side surface of the sidewall OW and an angle (not illustrated) between the bottom surface of the main body portion 100 and the sidewall of the partition portion 300 may also be larger than or equal to about 90°. Also, an inner width of the edge receiving portion PC may be maintained to be the same or may gradually increase upward from the bottom surface of the main body portion 100.

However, the present disclosure is not limited thereto, and forcibly removing the tray 10 from the mold may be possible according to a material constituting the tray 10, or when a mold including a slide core is used, the angle (not illustrated) between the bottom surface of the main body portion 100 and the inner side surface of the sidewall OW and the angle (not illustrated) between the bottom surface of the main body portion 100 and the sidewall of the partition portion 300 as well as the angle θ between the bottom surface of the main body portion 100 of the tray 10 and the sidewall of the guide portion 200 may be less than about 90°. Also, the edge receiving portion PC may include a section in which an inner width decreases upward from the bottom surface of the main body portion 100.

In the case of the tray 10 in which the angle θ between the bottom surface of the main body portion 100 of the tray 10 and the sidewall of the guide portion 200 is larger than or equal to about 90° and the inner width of the edge receiving portion PC is maintained to be the same or gradually increases upward from the bottom surface of the main body portion 100, since the tray 10 does not include an undercut structure, the tray 10 may be easily separated from the mold during the process of manufacturing the tray 10. Moreover, since the tray 10 may be manufactured using a mold having a relatively simple structure, the manufacturing cost may be reduced.

Hereinafter, the tray 10 according to another embodiment will be described. In the following description, description of configurations identical to those described above in relation to the previous embodiment will be omitted or simplified, and differences from the previous embodiment will be mainly described.

Figure 12:
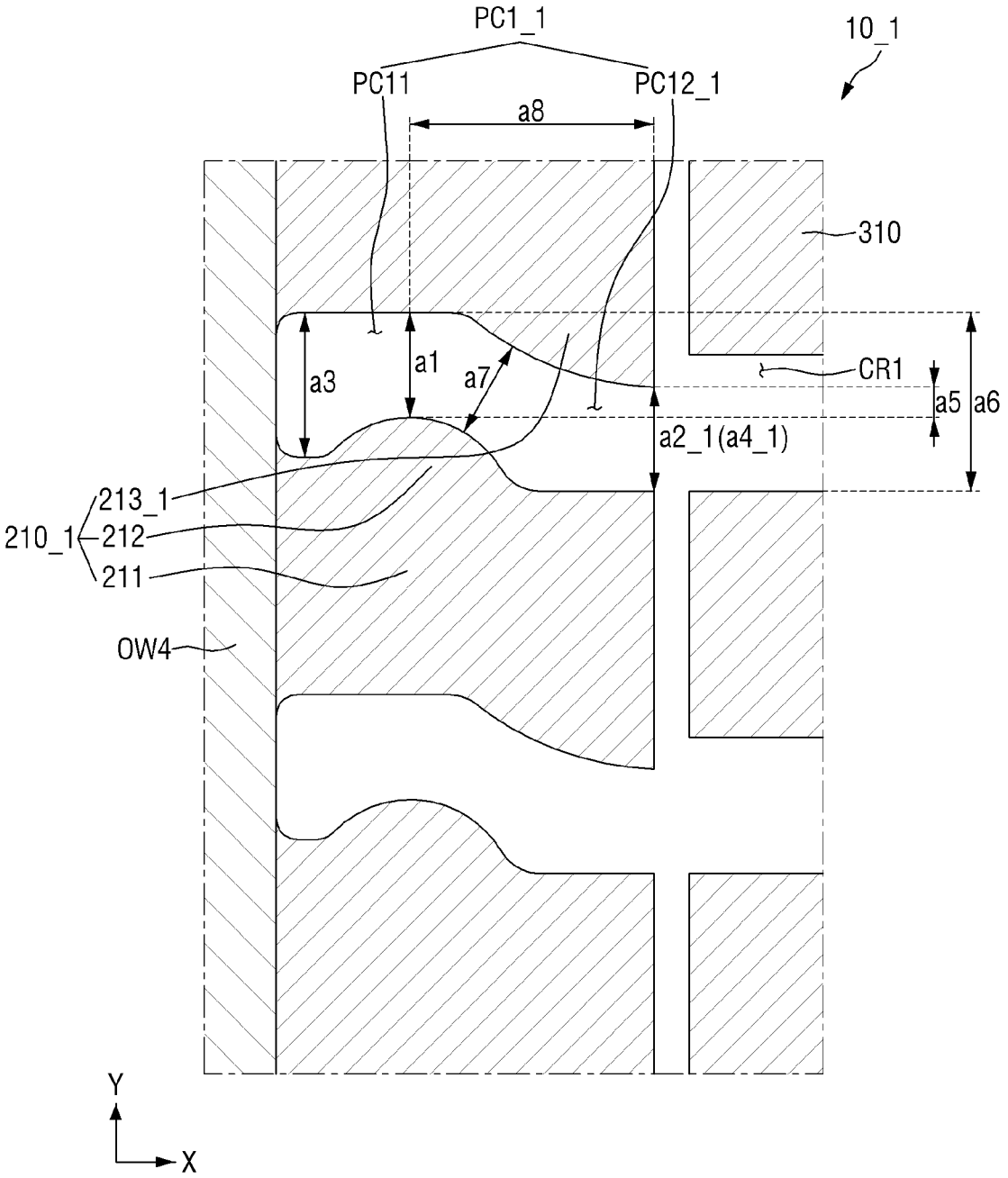
FIG. 12 is an enlarged view of a portion of the tray according to another embodiment.

FIG. 12 is an enlarged view of a portion of the tray according to another embodiment.

Referring to FIG. 12, a tray 10_1 according to the present embodiment is different from the tray 10 according to the previous embodiment in that the tray 10_1 includes a second sub-protruding portion 213_1 having a different shape.

In the present embodiment, the second sub-protruding portion 2131 may be disposed to protrude from the protruding end portion of the first main protruding portion 211 in the direction opposite to the second direction Y. The second sub-protruding portion 213_1 may have a structure in which a thickness gradually decreases from the protruding end portion of the first main protruding portion 211 toward the fourth sidewall OW4. Here, the thickness of the second sub-protruding portion 213_1 may refer to a thickness in the second direction Y. That is, the protruding end portion of the second sub-protruding portion 213_1 may be aligned with the protruding end portion of the first main protruding portion 211 in the second direction Y.

Also, in the first edge receiving portion PC1, a second width a2_1 between the protruding end portion of the second sub-protruding portion 213_1 of one first guide portion 2101 and the one side surface of the first main protruding portion 211 in the second direction Y of another first guide portion 210_1 that is disposed adjacent to the other side of the one first guide portion 210_1 in the second direction Y may be substantially the same as a fourth width a4_1 between one side end portion of the second sub-protruding portion 213_1 in the first direction X of one first guide portion 210_1 and the one side surface of the first main protruding portion 211 in the second direction Y of another first guide portion 210_1 that is disposed adjacent to the other side of the one first guide portion 210_1 in the second direction Y in the first edge receiving portion PC1.

Also, the first edge receiving portion PC1 may include the first sub-edge receiving portion PC11 that is defined at a position in the first direction X from the fourth sidewall OW4 and corresponds to the area up to the protruding end portion of the first sub-protruding portion 212. The first edge receiving portion PC1 may also include a second sub-edge receiving portion PC12_1 that is defined at a position in the direction opposite to the first direction X from the protruding end portion of the second sub-protruding portion 213_1 and corresponds to the area up to the protruding end portion of the first sub-protruding portion 212.

Since the tray 10_1 according to the present embodiment includes the first guide portion 2101 including the first sub-protruding portion 212 and the second sub-protruding portion 213_1 that are opposite to each other and alternately disposed, even when the thickness of the cover glass 1000 loaded on the tray 10_1 is small, the cover glass 1000 may be stably loaded thereon. Specifically, the gap between the guide portion 200 and the cover glass 1000 may be reduced to minimize damage to the cover glass 1000 during storage and transportation of the cover glass 1000 loaded on the tray 10_1.

Also, the tray 10_1 according to the present embodiment may secure the edge receiving portion PC to prevent damage to the print layer 1200 of the cover glass 1000 loaded on the tray 10_1.

Furthermore, since the tray 101 according to the present embodiment includes the second sub-protruding portion 213_1 of which the protruding end portion is aligned with the protruding end portion of the first main protruding portion 211, the space for loading the cover glass 1000 may be more easily adjusted. That is, since the second sub-protruding portion 213_1 is disposed further inward in the tray 101, designing the mold for manufacturing the tray 10_1 may be facilitated.

Figure 13:
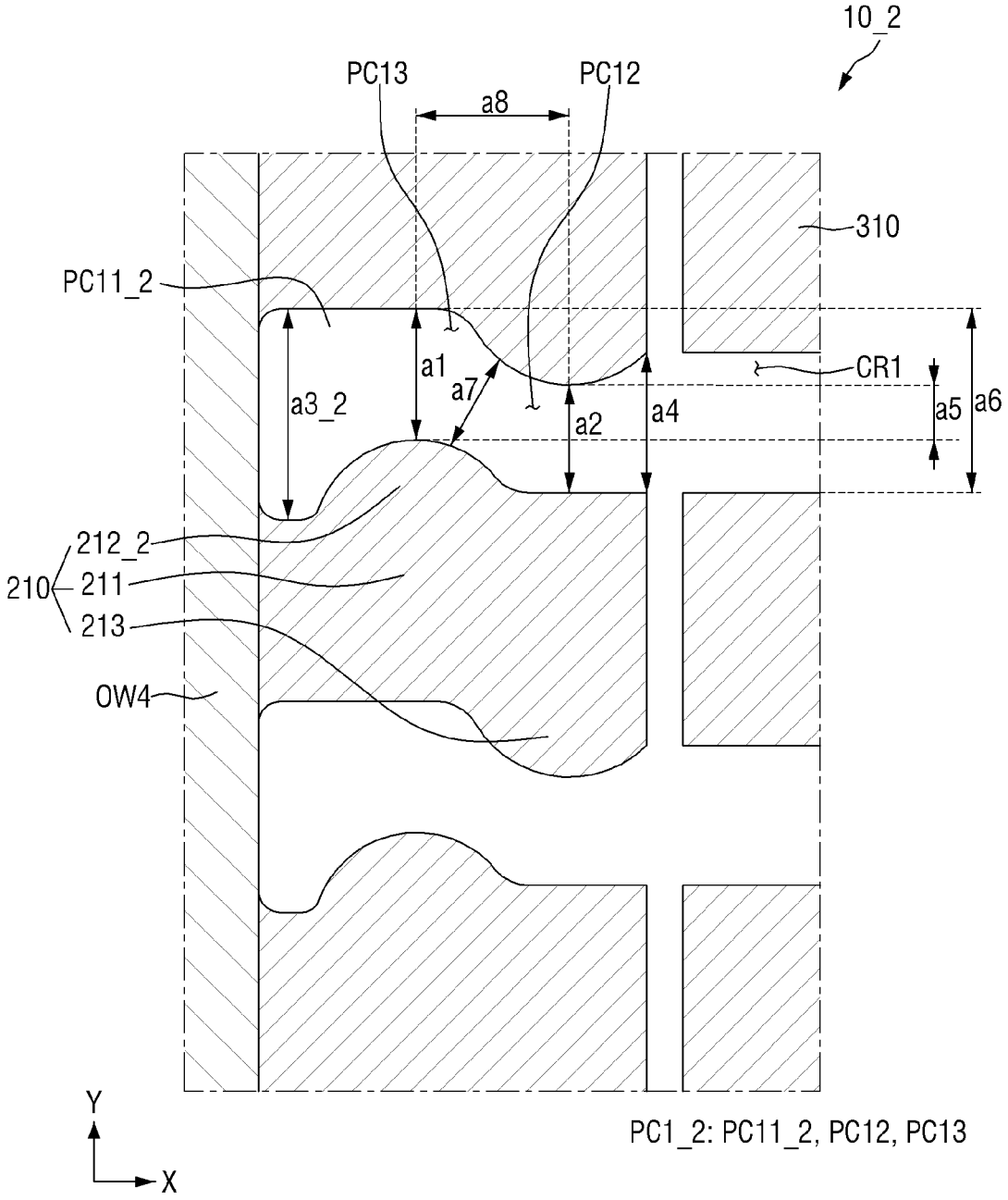
FIG. 13 is an enlarged view of a portion of the tray according to still another embodiment.

FIG. 13 is an enlarged view of a portion of the tray according to still another embodiment.

Referring to FIG. 13, a tray 10_2 according to the present embodiment is different from the tray 10 according to the previous embodiment in that the tray 10_2 includes a first sub-protruding portion 212_2 having a different shape.

In the present embodiment, a thickness of the first sub-protruding portion 212_2 at one side (i.e., left side) in the first direction X may be larger than a thickness thereof at the other side (i.e., right side) in the direction opposite to the first direction X. Here, the thickness of the first sub-protruding portion 2122 may refer to a thickness in the second direction Y.

Therefore, the side end portion of the first sub-protruding portion 212_2 in the direction opposite to the first direction X may have a shape that is more recessed in the direction opposite to the second direction Y than the side surface of the first main protruding portion 211 at the one side in the second direction Y.

In the first edge receiving portion PC1_2, a third width a3_2 in the second direction Y between an end portion of the first sub-protruding portion 212_2 in the direction opposite to the first direction X of one first guide portion 210_2 and a side surface of the first main protruding portion 211, in the direction opposite to the second direction Y, of another first guide portion 210_2 that is disposed adjacent to the one first guide portion 210_2 in the second direction Y may be larger than the fourth width a4 in the second direction Y between the one side end portion of the second sub-protruding portion 213 in the first direction X of one first guide portion 210_2 and the one side surface of the first main protruding portion 211 of another first guide portion 210_2 that is disposed adjacent to the one first guide portion 210_2 in the direction opposite to the second direction Y in the first edge receiving portion PC1.

Also, in the present embodiment, a first edge receiving portion PC1_2 may include a first sub-edge receiving portion PC11_2 that is defined at a position in the first direction X from the fourth sidewall OW4 and corresponds to the area up to the protruding end portion of the first sub-protruding portion 212_2. The first edge receiving portion PC1_2 may also include the second sub-edge receiving portion PC12 that is defined at a position in the direction opposite to the first direction X from the protruding end portion of the first main protruding portion 211 and corresponds to the area up to the protruding end portion of the second sub-protruding portion 213. The first edge receiving portion PC1_2 may also include the third sub-edge receiving portion PC13 that is defined between the first sub-edge receiving portion PC11_2 and the second sub-edge receiving portion PC12. The third sub-edge receiving portion PC13 may correspond to an area from the protruding end portion of the first sub-protruding portion 212_2 to the protruding end portion of the second sub-protruding portion 213 in the first direction X in the first edge receiving portion PC1.

The first sub-edge receiving portion PC11_2 may include a wider space than each of the second and third sub-edge receiving portions PC12 and PC13. Therefore, when the cover glass 1000 is loaded on the tray 10_2, the print layer 1200 disposed on the first sub-edge receiving portion PC11_2 may be more effectively protected.

Since the tray 10_2 according to the present embodiment includes the first guide portion 2102 including the first sub-protruding portion 212_2 and the second sub-protruding portion 213 that are opposite to each other and alternately disposed, even when the thickness of the cover glass 1000 loaded on the tray 10_2 is small, the cover glass 1000 may be stably loaded thereon. Specifically, the gap between the guide portion 200 and the cover glass 1000 may be reduced to minimize damage to the cover glass 1000 during storage and transportation of the cover glass 1000 loaded on the tray 10_2.

Also, the tray 10_2 according to the present embodiment may secure the edge receiving portion PC to prevent damage to the print layer 1200 of the cover glass 1000 loaded on the tray 102.

Furthermore, since the tray 10_2 according to the present embodiment secures the first sub-edge receiving portion PC11_2 including a wider space, when the cover glass 1000 is loaded on the tray 10_2, the print layer 1200 disposed on the first sub-edge receiving portion PC11_2 may be more effectively protected. For example, the tray 10_2 according to the present embodiment may effectively protect the print layer 1200 regardless of whether the print layer 1200 is disposed to face the second direction Y or the direction opposite to the second direction Y.

Figure 14:
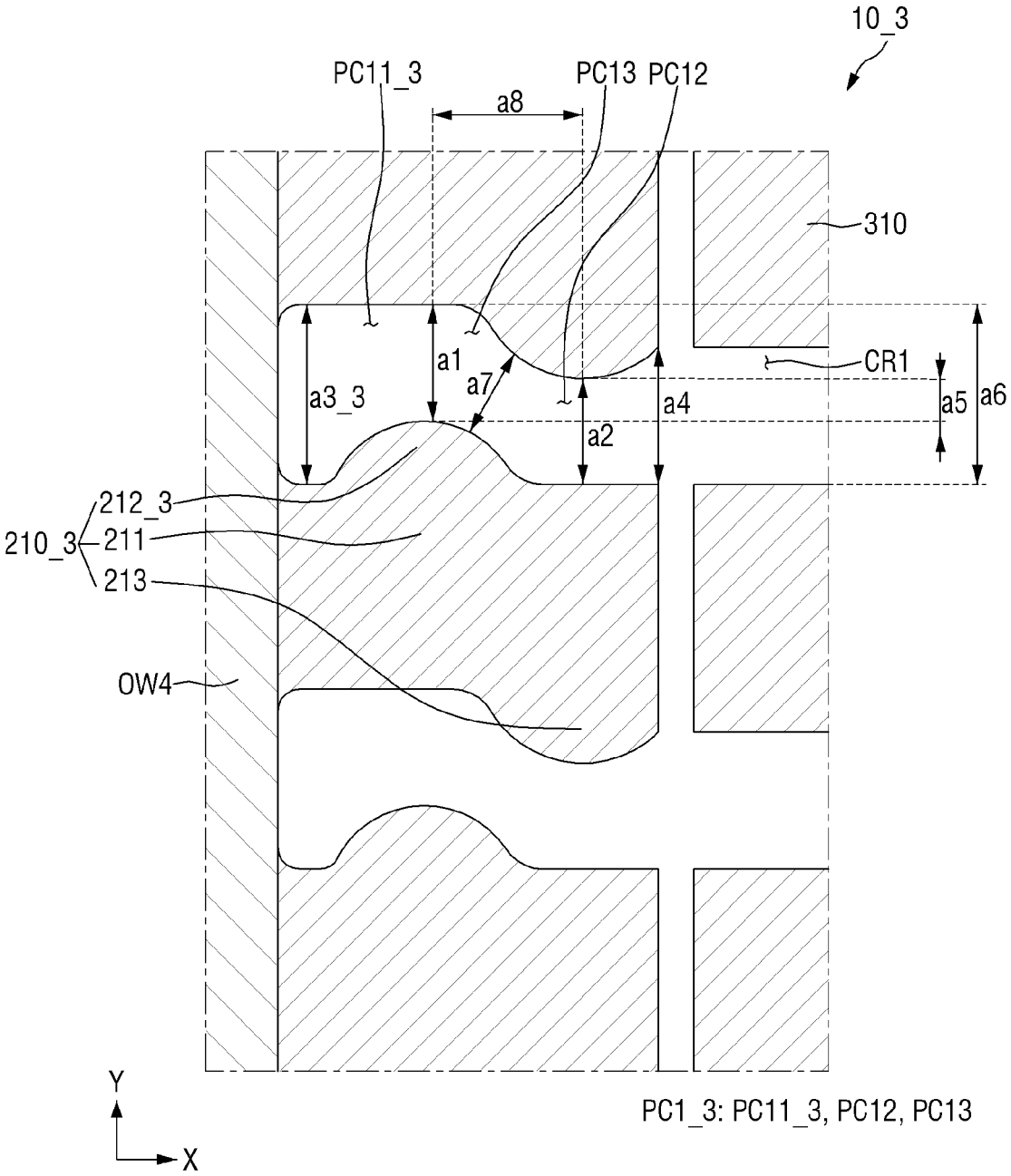
FIG. 14 is an enlarged view of a portion of the tray according to yet another embodiment.

FIG. 14 is an enlarged view of a portion of the tray according to yet another embodiment.

Referring to FIG. 14, a tray 10_3 according to the present embodiment is different from the tray 10 according to the previous embodiment in that the tray 10_3 includes a first sub-protruding portion 212_3 having a different shape. The first sub-protruding portion 2123 may have a shape in which a thickness in the second direction Y increases in the first direction X and then decreases. The first sub-protruding portion 212_3 may have a symmetrical structure with respect to a virtual line that passes through a protruding end portion thereof and extends in the second direction Y.

Therefore, an area disposed between the fourth sidewall OW4 and the other side end portion of the first sub-protruding portion 2123 in the first direction X may be aligned with the one side surface of the first main protruding portion 211 in the second direction Y.

In the first edge receiving portion PC1_3, a third width a3_3 in the second direction Y between an end portion of the first sub-protruding portion 2123 in the direction opposite to the first direction X of one first guide portion 210_3 and a side surface of the first main protruding portion 211, in the direction opposite to the second direction Y, of another first guide portion 210_3 that is disposed adjacent to the one first guide portion 210_3 in the second direction Y may be substantially the same as the sixth width a6 in the second direction Y between the virtual plane that extends from the side surface of the first main protruding portion 211 in the direction opposite to the second direction Y of one first guide portion 210_3 and the virtual plane that extends from the side surface of the first main protruding portion 211 in the second direction Y of another first guide portion 210_3 that is disposed adjacent to the side of the one first guide portion 210_3 in the direction opposite to the second direction Y in the first edge receiving portion PC1.

Also, in the present embodiment, a first edge receiving portion PC1_3 may include a first sub-edge receiving portion PC11_3 that is defined at a position in the first direction X from the fourth sidewall OW4 and corresponds to the area up to the protruding end portion of the first sub-protruding portion 212_3. The first edge receiving portion PC1_3 may also include the second sub-edge receiving portion PC12 that is defined at a position in the direction opposite to the first direction X from the protruding end portion of the first main protruding portion 211 and corresponds to the area up to the protruding end portion of the second sub-protruding portion 213. The first edge receiving portion PC1_3 may also include the third sub-edge receiving portion PC13 that is defined between the first sub-edge receiving portion PC11_3 and the second sub-edge receiving portion PC12. The third sub-edge receiving portion PC13 may correspond to an area from the protruding end portion of the first sub-protruding portion 212_3 to the protruding end portion of the second sub-protruding portion 213 in the first direction X in the first edge receiving portion PC1_3.

The first sub-edge receiving portion PC11_3 may include a wider space than each of the second and third sub-edge receiving portions PC12 and PC13. Therefore, when the cover glass 1000 is loaded on the tray 10_3, the print layer 1200 disposed on the first sub-edge receiving portion PC11_3 may be more effectively protected.

Since the tray 10_3 according to the present embodiment includes the first guide portion 210_3 including the first sub-protruding portion 212_3 and the second sub-protruding portion 213 that are opposite to each other and alternately disposed, even when the thickness of the cover glass 1000 loaded on the tray 10_3 is small, the cover glass 1000 may be stably loaded thereon. Specifically, the gap between the guide portion 200 and the cover glass 1000 may be reduced to minimize damage to the cover glass 1000 during storage and transportation of the cover glass 1000 loaded on the tray 10_3.

Also, the tray 10_3 according to the present embodiment may secure the edge receiving portion PC to prevent damage to the print layer 1200 of the cover glass 1000 loaded on the tray 103.

Furthermore, since the tray 10_3 according to the present embodiment secures the first sub-edge receiving portion PC11_3 including a wider space, when the cover glass 1000 is loaded on the tray 10_3, the print layer 1200 disposed on the first sub-edge receiving portion PC11_3 may be more effectively protected. For example, the tray 10_3 according to the present embodiment may effectively protect the print layer 1200 regardless of whether the print layer 1200 is disposed to face the second direction Y or the direction opposite to the second direction Y.

Figure 15:
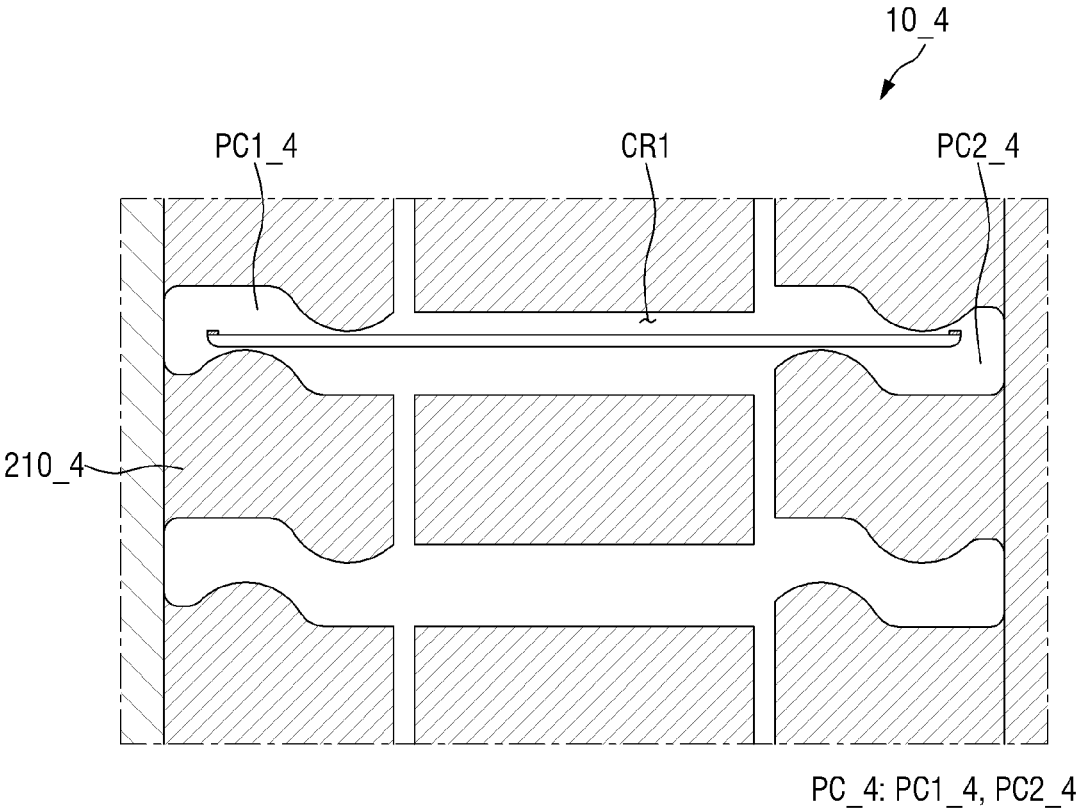
FIG. 15 is an enlarged view of a portion of the tray according to yet another embodiment.

FIG. 15 is an enlarged view of a portion of the tray according to yet another embodiment.

Referring to FIG. 15, a tray 10_4 according to the present embodiment is different from the tray 10 according to the previous embodiment in that a first edge receiving portion PC1_4 and a second edge receiving portion PC2_4 are in point symmetry to each other with respect to a midpoint of the first center receiving portion CR1 in a plan view.

In the tray 10_4 according to the present embodiment, since the first edge receiving portion PC1_4 and the second edge receiving portion PC2_4 are in point symmetry to each other as described above, a space in which the cover glass 1000 may be partially rotated while loaded on the tray 10_4 may be provided to be larger than that in the tray 10 according to the previous embodiment. Therefore, it may be easier to load the cover glass 1000 on the tray 10_4 or to detach the cover glass 1000 from the tray 10_4.

Since the tray 10_4 according to the present embodiment includes a first guide portion 210_4 including a first sub-protruding portion and the second sub-protruding portion that are opposite to each other and alternately disposed, even when the thickness of the cover glass 1000 loaded on the tray 10_4 is small, the cover glass 1000 may be stably loaded thereon. Specifically, the gap between the guide portion 200 and the cover glass 1000 may be reduced to minimize damage to the cover glass 1000 during storage and transportation of the cover glass 1000 loaded on the tray 10_4.

Also, the tray 10_4 according to the present embodiment may secure the edge receiving portion PC_4 to prevent damage to the print layer 1200 of the cover glass 1000 loaded on the tray 104.

Furthermore, since the tray 104 according to the present embodiment includes the first edge receiving portion PC1_4 and the second edge receiving portion PC2_4 that are in point symmetry to each other with respect to the midpoint of the first center receiving portion CR1 in a plan view, the process of loading the cover glass 1000 on the tray 10_4 or detaching the cover glass 1000 from the tray 10_4 may be easily performed.

According to an embodiment, a tray allows a cover glass to be stably loaded through a plurality of guide portions that are arranged alternately and include a protruding shape. Also, the tray includes an edge receiving portion separately provided on one side of the guide portion to prevent damage to a print layer formed on the cover glass.

Advantageous effects according to the embodiments are not limited to those mentioned above, and various other advantageous effects are incorporated herein.

In concluding the detailed description, those skilled in the art will appreciate that many variations and modifications can be made to the preferred embodiments without substantially departing from the principles of the present invention. Therefore, the disclosed preferred embodiments of the invention are used in a generic and descriptive sense only and not for purposes of limitation.

What is claimed is:

1. A tray comprising:

a main body portion including a bottom surface portion and a sidewall portion; and a plurality of first guide portions disposed on the bottom surface portion and arranged to be spaced apart from each other in a first direction, wherein each of the first guide portions includes a first main protruding portion, a first sub-protruding portion which protrudes from the first main protruding portion in the first direction, and a second sub-protruding portion which protrudes from the first main protruding portion in a direction opposite to the first direction, the first sub-protruding portion and the second sub-protruding portion are alternately arranged in a direction the first main protruding portion extends, the first sub-protruding portion and the second sub-protruding portion are each disposed only on both opposing terminal ends defining each first guide portion, and wherein, except for the first sub-protruding portion and the second sub-protruding portion, no sub-protruding portion protruded from the first main protruding portion in the first direction is disposed between the opposing terminal ends defining each first guide portion.

2. The tray of claim 1, wherein the first sub-protruding portion of the first guide portion is disposed further in the direction opposite to the first direction than the second sub-protruding portion of another first guide portion of the plurality of first guide portions and adjacent to the first guide portion in the first direction.

3. The tray of claim 2, wherein a gap in the first direction between the first sub-protruding portion of the first guide portion and the second sub-protruding portion of the another first guide portion is smaller than a gap in the first direction between the first main protruding portion of the first guide portion and the first main protruding portion of the another first guide portion.

4. The tray of claim 2, wherein a gap between the first sub-protruding portion of the first guide portion and the second sub-protruding portion of the another first guide portion is less than or equal to a gap in the first direction between the first sub-protruding portion of the first guide portion and the first main protruding portion of the another first guide portion.

5. The tray of claim 1, wherein a gap in the first direction between a side end portion, in a second direction intersecting the first direction, of the first guide portion and a side end portion, in the second direction, of another first guide portion of the plurality of first guide portions and adjacent to the first guide portion in the first direction is larger than a gap in the first direction between the first sub-protruding portion of the first guide portion and the first main protruding portion of the another first guide portion.

6. The tray of claim 1, wherein the first sub-protruding portion and the second sub-protruding portion partially overlap in the first direction.

7. The tray of claim 1, further comprising a plurality of second guide portions disposed to be opposite to the plurality of first guide portions in a second direction which intersects the first direction, wherein each of the second guide portions includes a second main protruding portion that is opposite to the first main protruding portion, a third sub-protruding portion which protrudes from the second main protruding portion in the first direction, and a fourth sub-protruding portion which protrudes from the second main protruding portion in the direction opposite to the first direction, and the third sub-protruding portion and the fourth sub-protruding portion are alternately arranged in a direction the second main protruding portion extends.

8. The tray of claim 7, wherein the first guide portion and the second guide portion have symmetrical shapes with respect to a virtual line that extends in the first direction and is equidistant from the first guide portion and the second guide portion.

9. The tray of claim 7, wherein the plurality of first guide portions and the plurality of second guide portions form a receiving line which extends in the first direction, and the receiving line is provided in plural, and the plurality of receiving lines are arranged in the second direction.

10. The tray of claim 1, wherein the first main protruding portion extends in a second direction which intersects the first direction.

11. The tray of claim 10, wherein the first main protruding portion has a shape protruding from the sidewall portion.

12. A tray comprising:

a main body portion including a bottom surface portion and a sidewall portion;

a first guide portion disposed on the bottom surface portion; and a second guide portion disposed to be spaced apart from the first guide portion, wherein the first guide portion includes a first sub-protruding portion which protrudes toward the second guide portion, the second guide portion includes a second sub-protruding portion which protrudes toward the first guide portion, the first sub-protruding portion and the second sub-protruding portion are alternately arranged in a direction the first main protruding portion extends, the first sub-protruding portion and the second sub-protruding portion are each disposed only on both opposing terminal ends defining each first guide portion, wherein, except for the first sub-protruding portion and the second sub-protruding portion, no sub-protruding portion protruded from the first main protruding portion in the first direction is disposed between the opposing terminal ends defining each first guide portion.

13. The tray of claim 12, wherein the second guide portion is disposed at a side of the first guide portion in a first direction, and the second sub-protruding portion is located further in the first direction than the first sub-protruding portion.

14. The tray of claim 13, wherein a gap in the first direction between the first sub-protruding portion and the second sub-protruding portion is less than or equal to a gap in the first direction between the first sub-protruding portion and the second guide portion.

15. The tray of claim 13, wherein the first guide portion and the second guide portion each have a shape which protrudes in a second direction, which intersects the first direction, from the sidewall portion.

16. The tray of claim 15, wherein a gap in the first direction between an end portion of the first guide portion and an end portion of the second guide portion that are connected to the sidewall portion is larger than a gap in the first direction between the first sub-protruding portion and the second guide portion.

17. The tray of claim 13, wherein the first sub-protruding portion and the second sub-protruding portion partially overlap in the first direction.

18. The tray of claim 12, wherein:

the first guide portion and the second guide portion are arranged in a first direction, the tray further comprises a third guide portion which is disposed to be opposite to the first guide portion in a second direction, which intersects the first direction, and a fourth guide portion which is disposed to be opposite to the second guide portion in the second direction, the third guide portion includes a third sub-protruding portion which protrudes in the first direction, the fourth guide portion includes a fourth sub-protruding portion which protrudes in a direction opposite to the first direction, and the third sub-protruding portion and the fourth sub-protruding portion are alternately disposed.

19. The tray of claim 18, wherein the first guide portion and the third guide portion have symmetrical shapes with respect to a virtual line that extends in the first direction and is equidistant from the first guide portion and the third guide portion.

20. The tray of claim 18, wherein:

the first guide portion, the second guide portion, the third guide portion, and the fourth guide portion form a receiving line which extends in the first direction, and the receiving line is provided in plural, and the plurality of receiving lines are arranged in the second direction.

* * * * *